US011299319B2

(12) United States Patent
Bayona Salazar et al.

(10) Patent No.: US 11,299,319 B2
(45) Date of Patent: Apr. 12, 2022

(54) STACKABLE COVER WITH BEVERAGE CAN OPENER

(71) Applicant: Invnobel S.A.S., Bogota (CO)

(72) Inventors: Victor Martin Bayona Salazar, Bogota D.C. (CO); Rafael Ricardo Molano Camacho, Bogota D.C. (CO)

(73) Assignee: INVNOBELS.A.S., Bogota (CO)

( * ) Notice: Subject to any disclaimer, the term of this patent is extended or adjusted under 35 U.S.C. 154(b) by 113 days.

(21) Appl. No.: 16/753,459

(22) PCT Filed: Oct. 4, 2018

(86) PCT No.: PCT/CO2018/000022
§ 371 (c)(1),
(2) Date: Apr. 3, 2020

(87) PCT Pub. No.: WO2019/068270
PCT Pub. Date: Apr. 11, 2019

(65) Prior Publication Data

US 2020/0317395 A1 Oct. 8, 2020

(30) Foreign Application Priority Data

Oct. 5, 2017 (CO) ..... NC2017/0010123

(51) Int. Cl.
*B65D 17/00* (2006.01)
*B65D 17/36* (2006.01)
(Continued)

(52) U.S. Cl.
CPC ..... *B65D 17/36* (2018.01); *B65D 43/0204* (2013.01); *B65D 51/18* (2013.01);
(Continued)

(58) Field of Classification Search
CPC ..... B65D 17/36; B65D 17/4012; B65D 43/0204; B65D 51/18; B65D 71/00; B65D 2517/0014; B67B 7/12; B67B 7/40
(Continued)

(56) References Cited

U.S. PATENT DOCUMENTS 4,869,389 A * 9/1989 Cerrone, Jr. ..... B65D 17/36 220/713
6,073,797 A 6/2000 Barous
(Continued)

FOREIGN PATENT DOCUMENTS

WO 2015042582 A1 3/2015

OTHER PUBLICATIONS

International Application No. PCT/CO2018/000022, international Search Report and Written Opinion, dated Jan. 15, 2019, 23 pages.

*Primary Examiner* — King M Chu
(74) *Attorney, Agent, or Firm* — Leber IP Law; Celia H. Leber

(57) ABSTRACT

The present invention relates to a top lid for beverage cans, with an opener built into a hygienic cover. The hygienic cover is designed to cover the area around the opening part defined in the top lid, thereby protecting the contact portion of the lip of the top lid from atmospheric impurities and keeping the can clean during storage. The hygienic cover also has an opening system that presses on the opening part of the lid and breaks the part along the recessed seam when the cover is levered. The opening system has a reinforcement notch that improves the rigidity of the opening system, such that the opening system reliably breaks the opening part of the lid without failure, even if a high pressure is acting on the inner surface of the opening part. The configuration and arrangement of the notch in the opening system can be changed freely according to the design conditions of the can, or the internal pressure acting on the
(Continued)

opening part and the size of the can. The hygienic cover also includes a handle that can be operated by the user with the fingers in order to lift same. This handle makes it easy for a user to grip and handle the cover while lifting said cover in order to open the top lid of the beverage can.

31 Claims, 31 Drawing Sheets

(51) Int. Cl.

| | |
|---|---|
| ***B65D 43/02*** | (2006.01) |
| ***B65D 51/18*** | (2006.01) |
| ***B65D 71/00*** | (2006.01) |
| ***B67B 7/12*** | (2006.01) |
| ***B67B 7/40*** | (2006.01) |

(52) U.S. Cl.
CPC ..... *B65D 71/00* (2013.01); *B67B 7/12* (2013.01); *B67B 7/40* (2013.01)

(58) Field of Classification Search
USPC ..... 220/256.1, 254.1
See application file for complete search history.

(56) References Cited

U.S. PATENT DOCUMENTS

| | | | | |
|---|---|---|---|---|
| 6,450,358 | B1 | 9/2002 | Berro | |
| 2012/0073997 | A1 | 3/2012 | Borg | |
| 2015/0197366 | A1* | 7/2015 | Chapin ..... | B65D 51/22 220/254.1 |
| 2016/0236813 | A1 | 8/2016 | Chapin | |
| 2018/0086524 | A1 | 3/2018 | Tetreault et al. | |

* cited by examiner

STACKABLE COVER WITH BEVERAGE CAN OPENER

CROSS-REFERENCE TO RELATED APPLICATIONS

This is a 35 U.S.C. 371 National Stage Patent Application of International Application No. PCT/CO2018/000022, filed Oct. 4, 2018, which claims priority to Columbian application NC2017/0010123, filed Oct. 5, 2017, each of which is hereby incorporated by reference in its entirety.

TECHNICAL FIELD

This invention refers in general to beverage cans made of metals, such as aluminum or steel, and specifically to coverages for the upper portion of such canned beverages with an opener built into a hygienic cover, being the hygienic coverage joined to the upper lid of the can and being designed to hygienically cover the lip contact portion of the upper lid by using the coverage portion thereof during storage of the can and reliably open the upper lid without failure by using the opening mechanism thereof.

STATE OF THE ART

There currently are molds and covers in the industry for food containers and cans for canned beverages; the use of aluminum or metal containers, termed "cans" is known in the food sector for both solid and liquid foods. In the first case, canned food has become widely popular thanks to the safety such type of packaging affords regarding conservation of food characteristics and ease of use.

Whether you are a producer of beer, soft drinks, energy drinks or other functional beverages, due to the increased competition in the retailing sector, it is necessary for such beverages to capture the attention of the buyer at the point of purchase.

Beverage cans have a large printable surface area which serves as a 360 -degree display for brands in racks, which is not usually available with other packaging formats. Furthermore, high definition printing allows brands to feature elaborated designs as well as bold and strong colors directly on the aluminum can, thus increasing consumer interaction with the packaging while communicating a single identity.

Beverage cans are valued for the portability and convenience thereof. Light and lasting, which are an ideal supplement for active lifestyles without any risk of accidental breakage. Metal cans also offer a powerful barrier against light and oxygen, which may affect beverage taste and freshness. Furthermore, beverage cans are cooled faster than other materials so that customers may enjoy such refreshing drinks.

Everybody benefits from the sustainability of the metal, which is 100% and infinitely recyclable, that is, it includes the sector of liquid foods, especially, the field of refreshing and other drinks, such as beers, the widespread use of cans is now unquestionable. Nevertheless, it is concerning in either case the difficulty found in storing a part of the content of the beverage once the can is opened, being especially complicated for beverage cans due to the liquid nature of the product contained therein, as once the can is opened, immediate consumption is required of all contents of the same given the risk of accidental spillage. This problem becomes obvious in those situations where the consumer is subject to abrupt movements such as those inside a motor vehicle.

The opening systems of metal cans for liquid food vary significantly in the technical embodiment of the same, yet in short they all coincide in sectioning a segment of the upper lid of the can in order to obtain an opening through which the liquid pours. In order to separate this segment, two systems have been basically developed which always involve a metal part in the shape of a ring that is joined to the lid itself.

It has been said that "Insofar as they are basically made of aluminum, the same may be in contact with the food held thereby". The above is false insofar as the evolution of metal containers has led to the placement of a protective interior lacquer which prevents contact of the metal with the beverage and consequently precludes migration of harmful substances.

And it has also been said that "The refreshing drink cans stocked in large stores for subsequent distribution thereof are mostly infected by rodents that freely wander around" which is something that still takes place despite the fact that distributor buildings must meet the same sanitary regulations as manufacturers. At this time, year 2016, in the XXI century, the hygiene awareness regarding beverage cans has somewhat advanced, yet it still is practically non-existent for purposes of protecting the consumer from the dangers that might arise from drinking from cans highly exposed to dirt, bacteria, infections, excrements, or animal residues and what is more important the little thought given to the small ones, who unknowingly sip from such cans repeatedly.

"It is necessary to improve little by little the sanitary measures regarding those products known as canned goods and for manufacturers of this type of containers to responsibly assist in a simple manner to the preservation of health as there is the possibility of contagion or first-hand knowledge of the events transpiring at storage places. In many instances there are rodents and uncleanliness at these spaces in general, which may result in contact with a human through such can, thus producing contamination and especially contagion.

We have come to realize just how necessary is to have a protective hygienic cover, whose purpose is improving hygiene and warn consumers that such containers must not be in direct contact with their mouths, if the opening system is not protected as it is exposed to contamination. It is desirable to have a device that reduces the exposition of upper surfaces of the container to contaminants.

Insofar as the device of this invention can be easily manufactured in an injection molding operation employing a suitable matrix, the same can be mass produced at a small cost and may be treated as reusable or disposable along with the can itself.

This invention is clearly new and useful. Furthermore, it was not evident for technical experts at the time it was made in light of the prior art.

Thus it shall be seen that the aforesaid objects and those provided from the above description are efficiently achieved and given that certain changes can be made in the preceding construction without departing from the scope of the invention, it is intended that all questions contained in the preceding construction or shown in the enclosed drawings shall be interpreted as being for illustrative and limiting purposes.

DESCRIPTION OF THE INVENTION

Our invention relates to a certain hygienic cover with a can opener in a single part, stackable, with handles and easily detachable zones, which thanks to its conformation and configuration allows protecting the entire area (100%) against direct exposition of the can—from highly harmful external agents for our health, without losing the piling, palletizing and storing function in general and on the contrary it makes the same safer, more convenient and efficient as it prevents unpiling of the products; besides solving other problems such as: easy opening of the can, given that our translucid cover allows complete visualization of the upper part of the can, which due to being protected prevents the opening tab from being turned so that it is always found in an adequate position and hence such operation is performed with our attachment and coupling systems, thus avoiding damage to children and nails of individuals and especially eliminating direct contact during manipulation.

We have also found other advantages, such as facilitating transport or movement from the purchase store to the consumption area, as it features handles which additionally allow easy detachment of the number of cans desired, from one and up to six units given that this is most common or standard form in which the same are stored.

DESCRIPTION OF THE DRAWINGS

As shown in FIG. 1, a standard beverage can includes a top surface 100' of the beverage can 1, wherein a sealing element 101' is perforated thus contacting such perforated portion the edge 102' of the top portion 100' of the beverage can 1. The sealing element 101' and the perforated edge 102' are frequently located in a recess or flanked by ridges and grooves 104' which reinforce the top surface 100' of the beverage can 1 in the area surrounding the edge 102' of the punch so that the punching mechanism shall break more easily upon opening the beverage can 1. Furthermore, an attachment 103' creates a mounting point for a traction tab 110' on the beverage can 1, more frequently due to the use of a rivet 103'. In order to open the beverage can 1, the traction tab 110' is lifted so that a pressure portion 112' of the traction tab 110' is pressed downward against the sealing element 101', which will be reduced and create an opening (not shown) in the beverage can 1 along the punched edge 102' on the top surface 100' of the beverage can 1. A regular handle 111' for opening said beverage can 1 is provided for positioning the thumb over the sealing element 101' and for using the index or middle finger to lift the handle 111' of the traction tab 110'.

Figure 2:
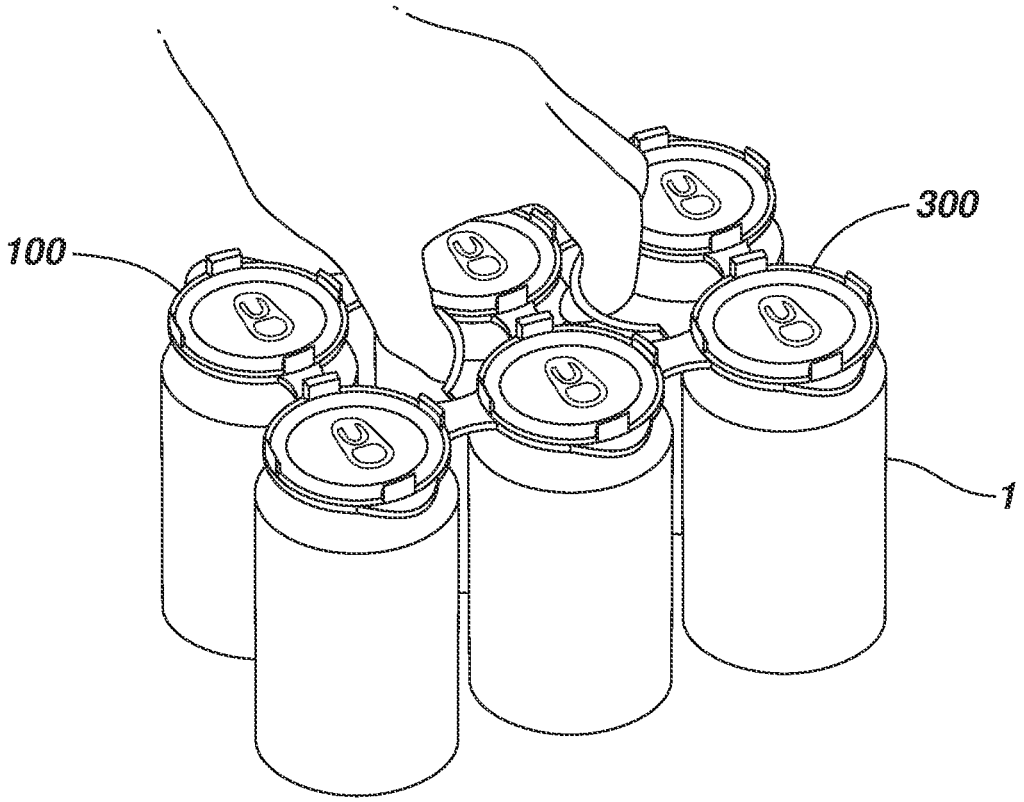
FIG. 2 is a top perspective view of a novel pack constructed according to this invention and depicts the carrier, which is interlockingly fixed to a plurality of cans wherein each can includes a weakened line which defines a tear-away portion and the support which includes a plurality of covers wherein an articulated traction tab portion is disposed on the interior edge thereof.

In regard to FIG. 2 it depicts a novel package constructed according to this invention, it depicts a carrier 300 which is interlockingly fixed to a plurality of beverage cans 1, the carrier 300 includes a weakened line 303 which defines a tear-away portion 304 and the carrier 300 which includes a plurality of covers 100 in each of which a beverage can 1 is disposed, which superficially fit in the thin circular edge 105' of the top surface 100' of the beverage can 1 and said thin circular border 105' of the beverage can 1 fits inside the internal circular cavity 115' of the covers 100, said covers 100 are depicted in greater detail in FIGS. 3A-3F, 4A-4E and 5A-5G.

Going back to FIGS. 3A-3E, they depict a top view of a cover 100 configured to be placed and secured on the top surface 100' of a beverage can 1 by means of attachment structures 121 located on the lower edge 106 of the cover 100, which superficially fit in the thin circular edge 105' of the top surface 100' of the beverage can 1 and said thin circular edge 105' of the beverage can 1 fits inside an internal circular cavity 115' of the cover 100. In one embodiment, the cover 100 comprises a body 101 which is made of polymer or copolymer material and the body 101 defines a top surface 104 (which is facing upward in FIGS. 3A-3E) which is configured to be attached to a base of a first beverage can 1 and a hollow interior 109 (facing downwards in FIGS. 5A-5G) the top surface comprising a protruding edge 106 connected to the cover material, which protruding edge is configured to surround the periphery of the cover, the protruding edge 106 comprising an inner wall 108 adjacently placed to the cover 100 and an outer wall 115 distally disposed to the cover 100 relative to the inner wall 108, being the inner 108 and outer 115 walls substantially parallel to each other, thus defining the internal cavity 115' receiving the edge of the beverage can 1, configured to receive and surround the thin edge 105' of the beverage can 1, further configuring the receiving area 115' as a crevice to be supported on the thin edge 105' of the beverage can 1 thus allowing the cover 100 to cover the top surface 104 of the beverage can 1; wherein the protruding edge 106 is connected to the outer wall 115, being the protruding edge 106 configured to cover the intersection between the protruding edge 106 and the thin edge 105' of the beverage can 1 to prevent dust or other impurities from settling on the same.

Figure 5A:
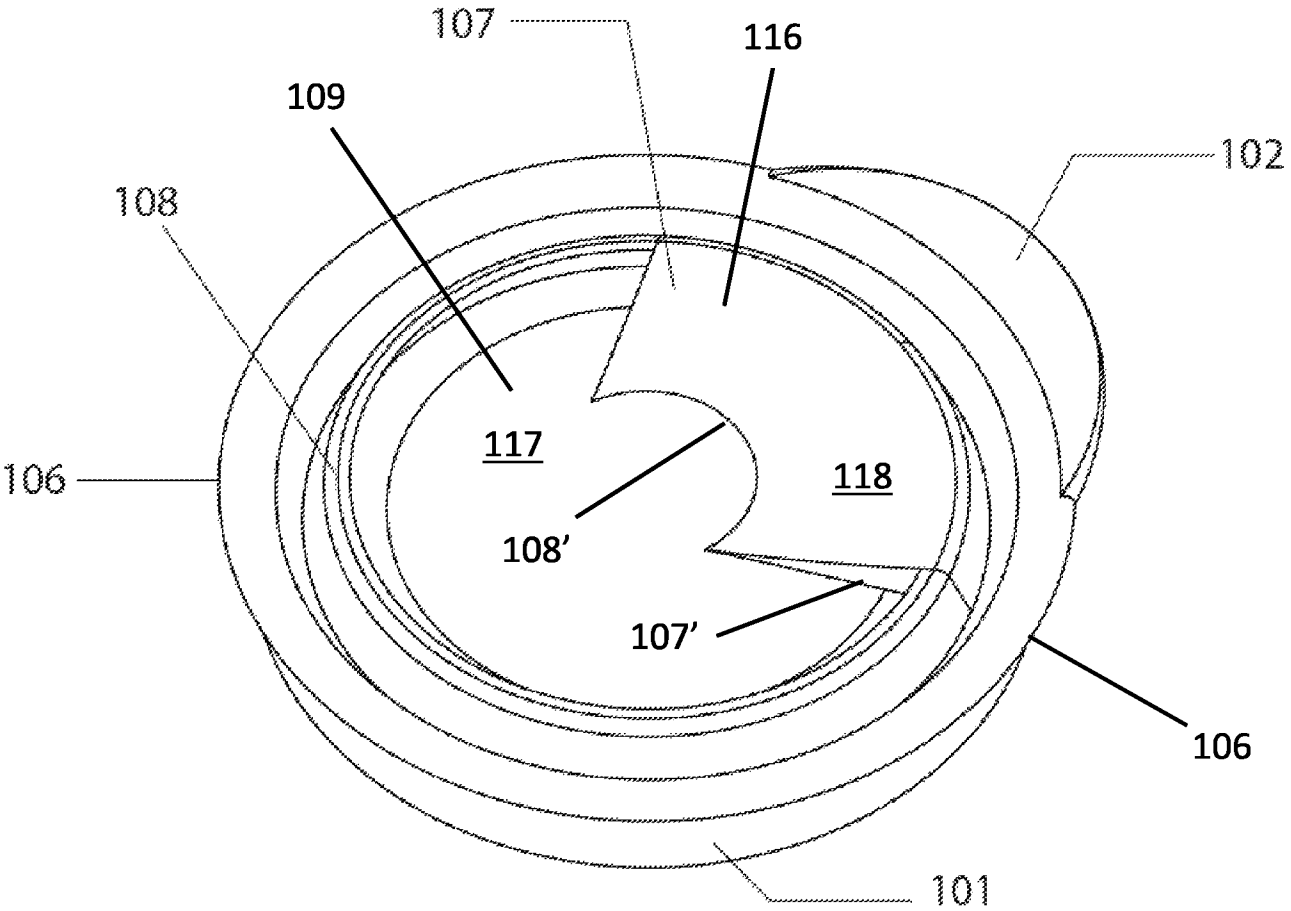
FIGS. 5A-5G depict bottom views of the cover according to several embodiments of this invention.
Figure 5B:
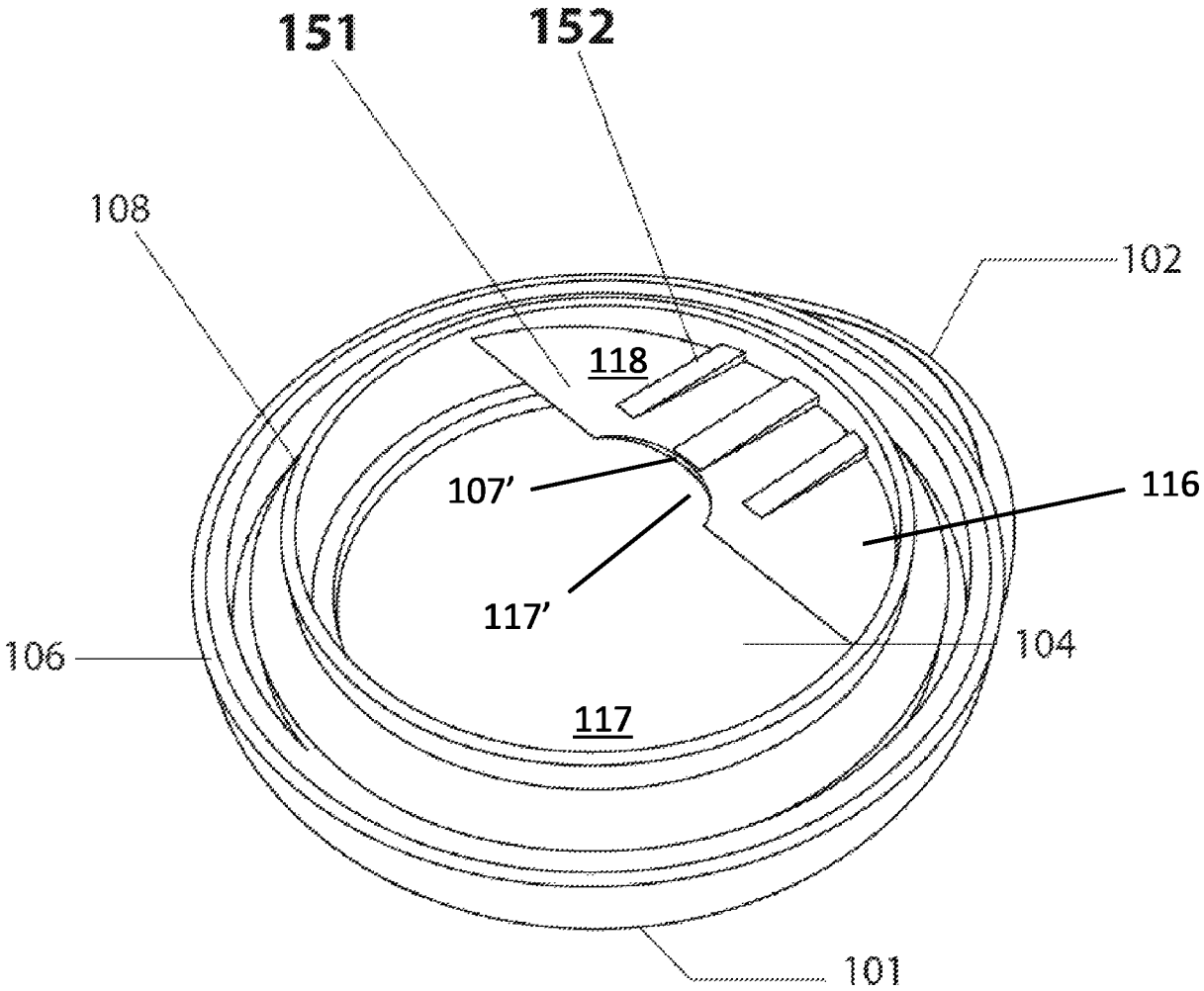
Figure 5C:
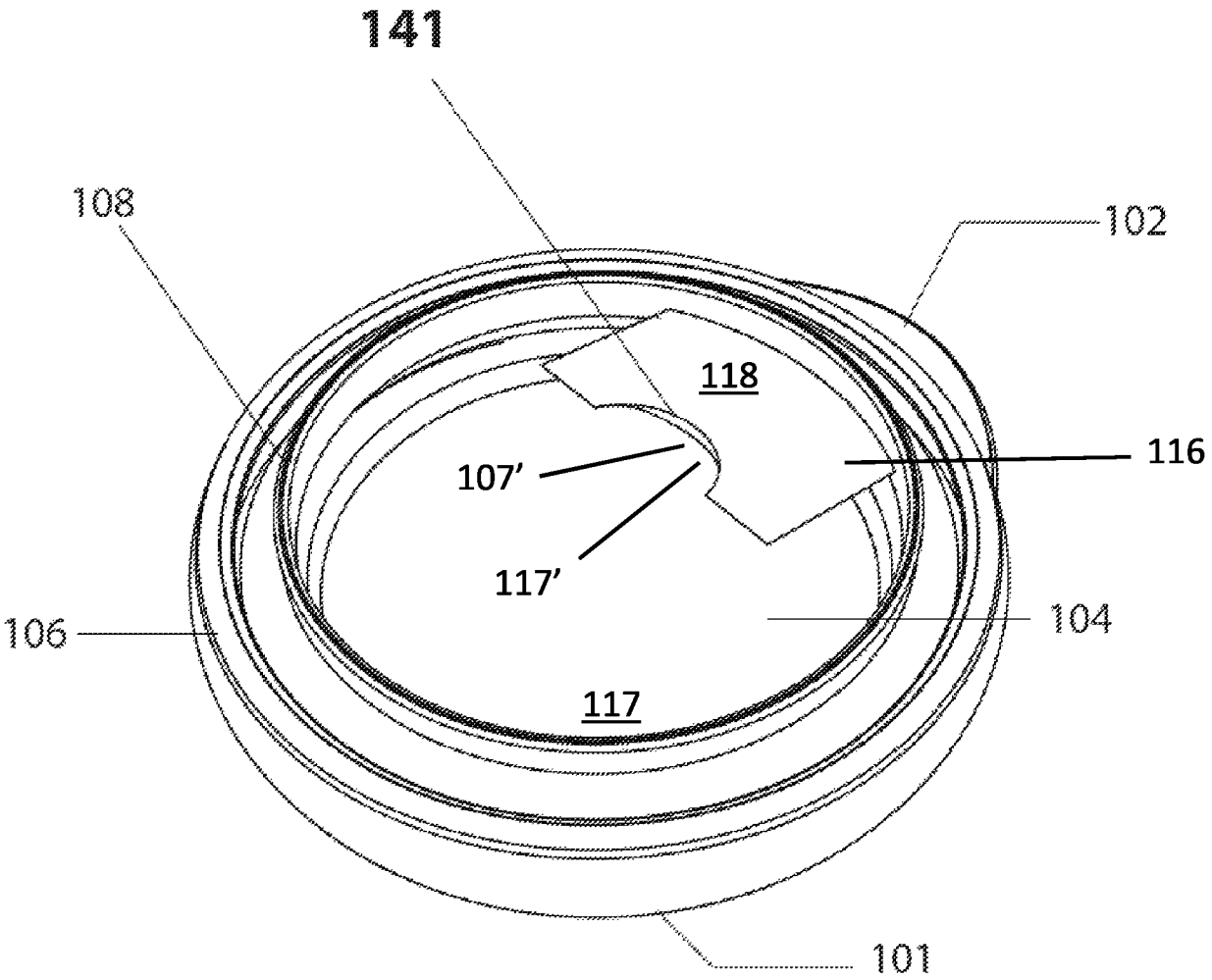
Figure 5D:
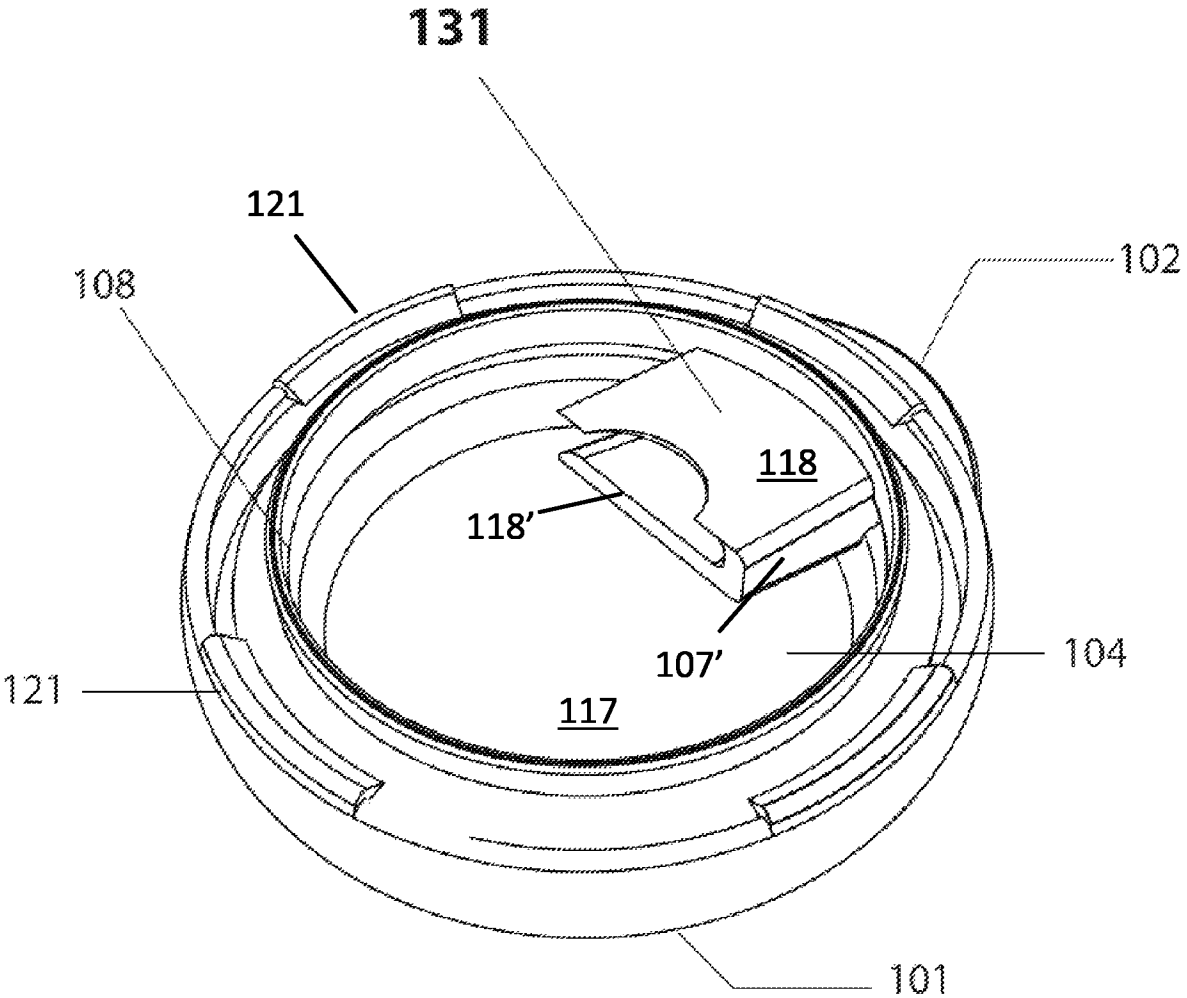

In one embodiment of the invention, four external attachment structures 121 may be formed radially over the lower edge 106 of the outer wall 115 of the body 101 of the cover 100 around a substantially circular external perimeter formed by an X radius, wherein the radial displacement between the exterior attachment structures 121 is the same and four attachment structures are provided; however in alternative embodiments, the number of attachment structures may be uneven and/or a different number, such as three or six attachment structures 121 as shown in FIG. 5D.

An exterior handle 102 is formed on the side of the outer wall 115 of the body 101 of the cover 100 extending downwards. The handle 102 is preferably dimensioned to be gripped by the fingers of a user. The handle 102 preferably has a semicircular or dome shape. Of course, the handle 102 may be created with other shapes. The cover 100 is preferably made of polymers known in the art and is preferably made in a conventional molding process. A mold can be made so that the material of the cover 100, the plurality of surfaces, walls, edges, the handle and the opening system are formed from a single piece upon molding and curing of the polymer.

Figure 3A:
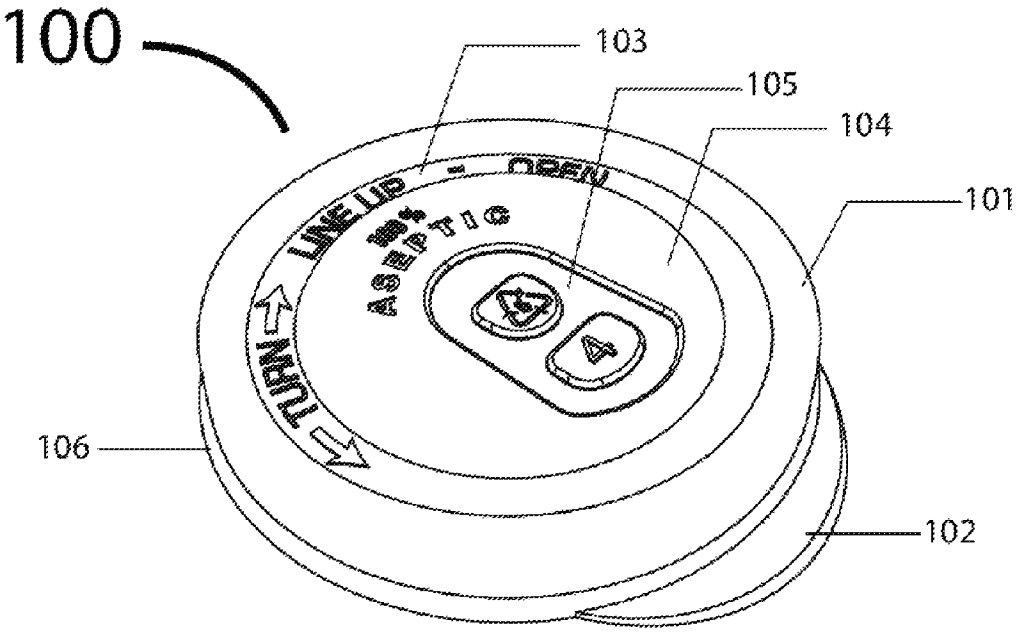
FIGS. 3A-3F depict a top view of the cover according to several embodiments of this invention.
Figure 3B:
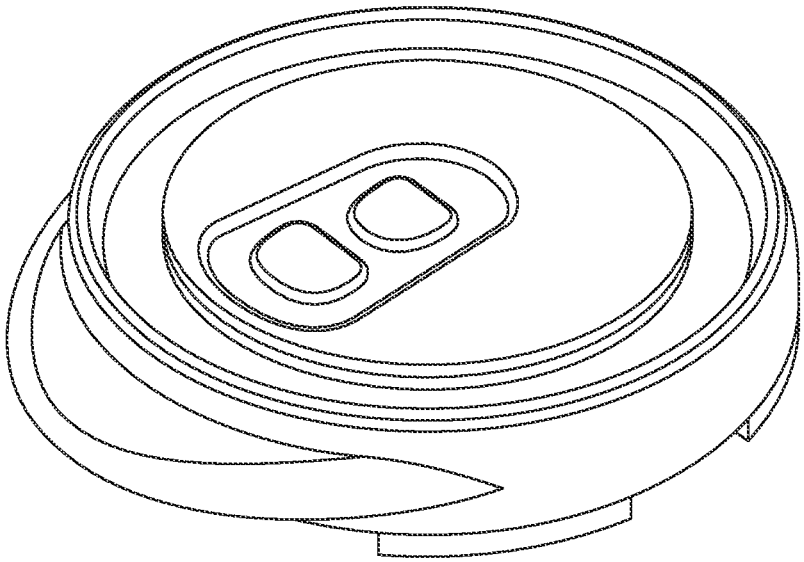
Figure 3C:
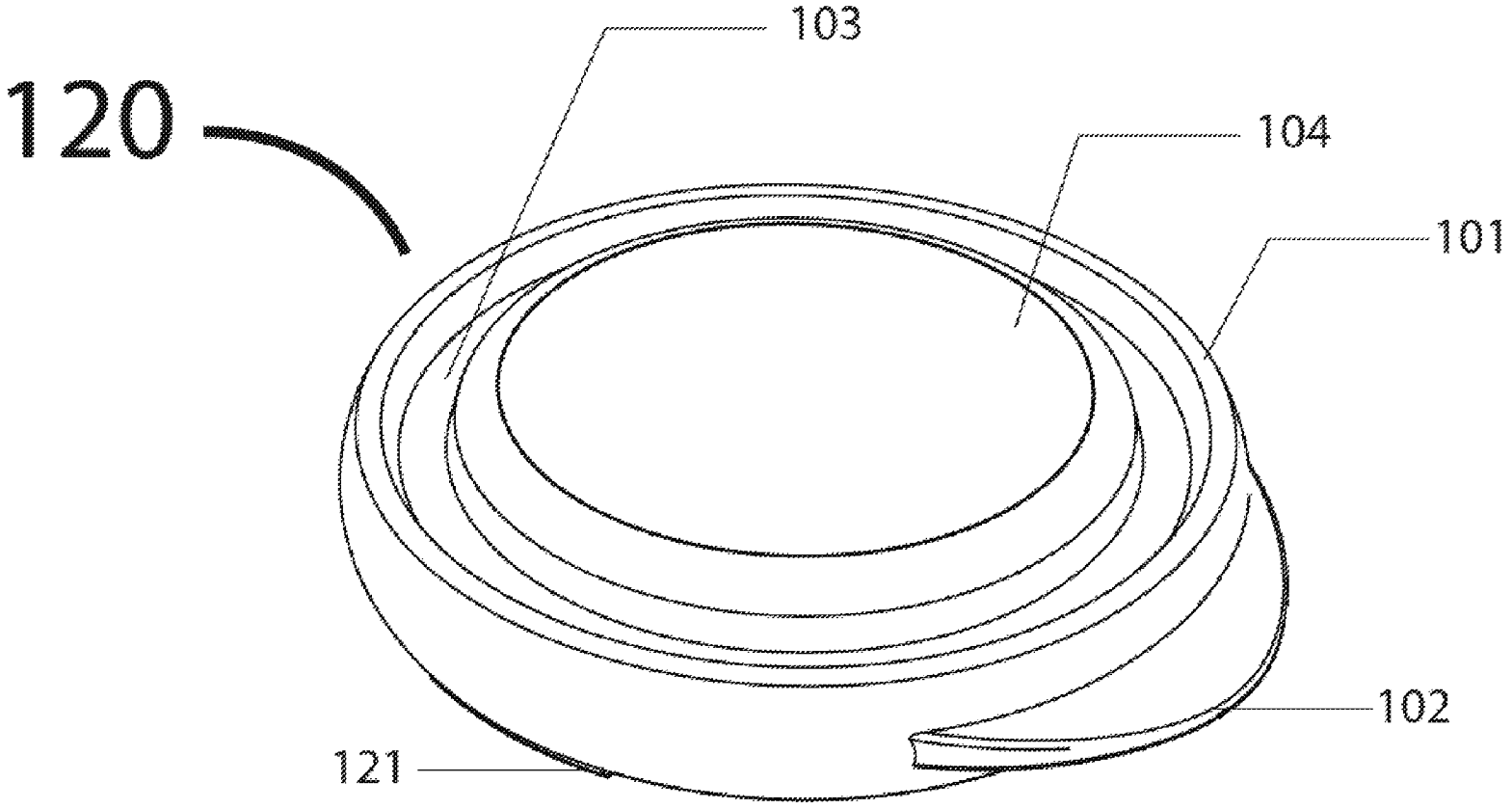
Figure 3D:
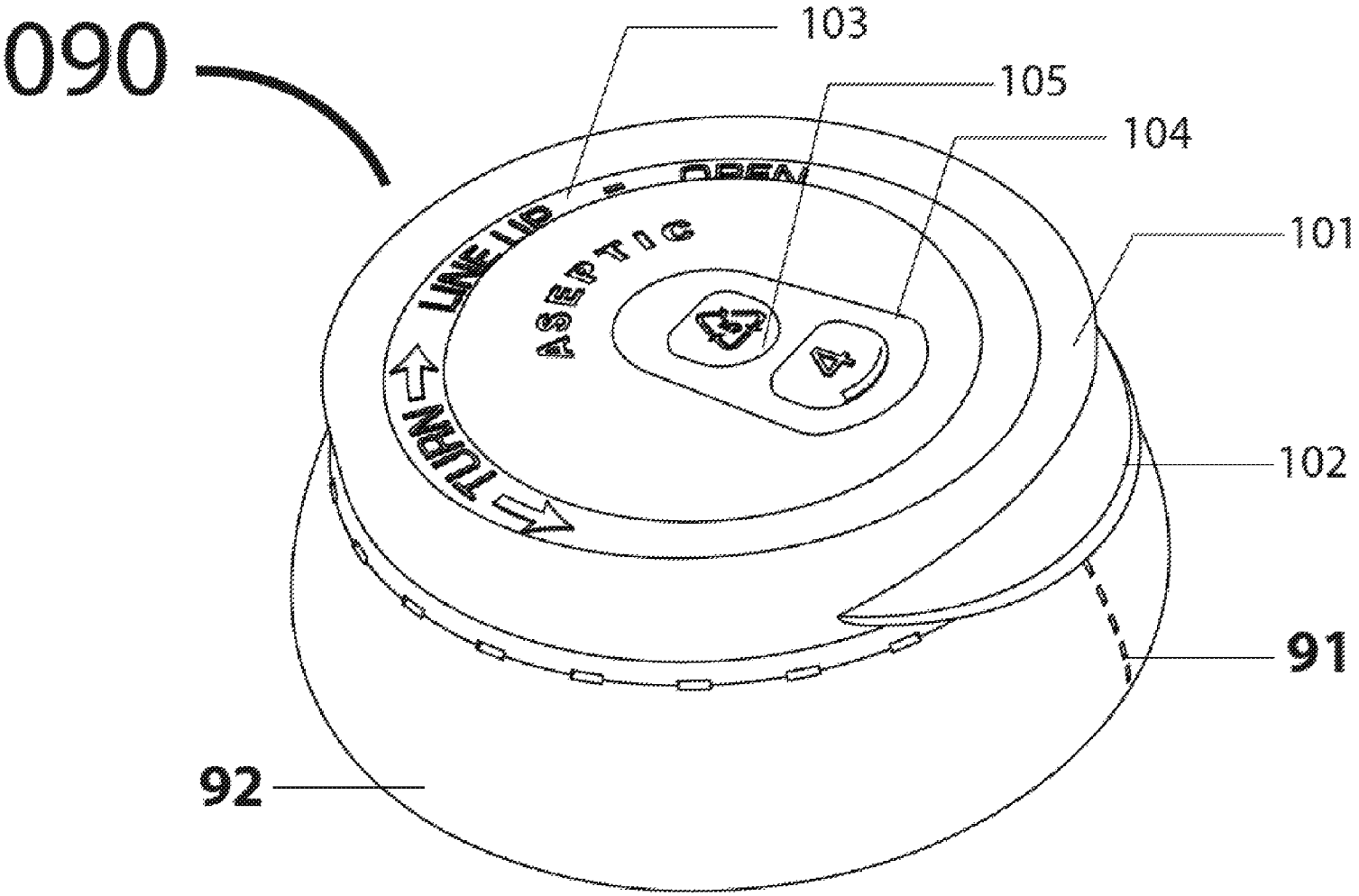
Figure 3E:
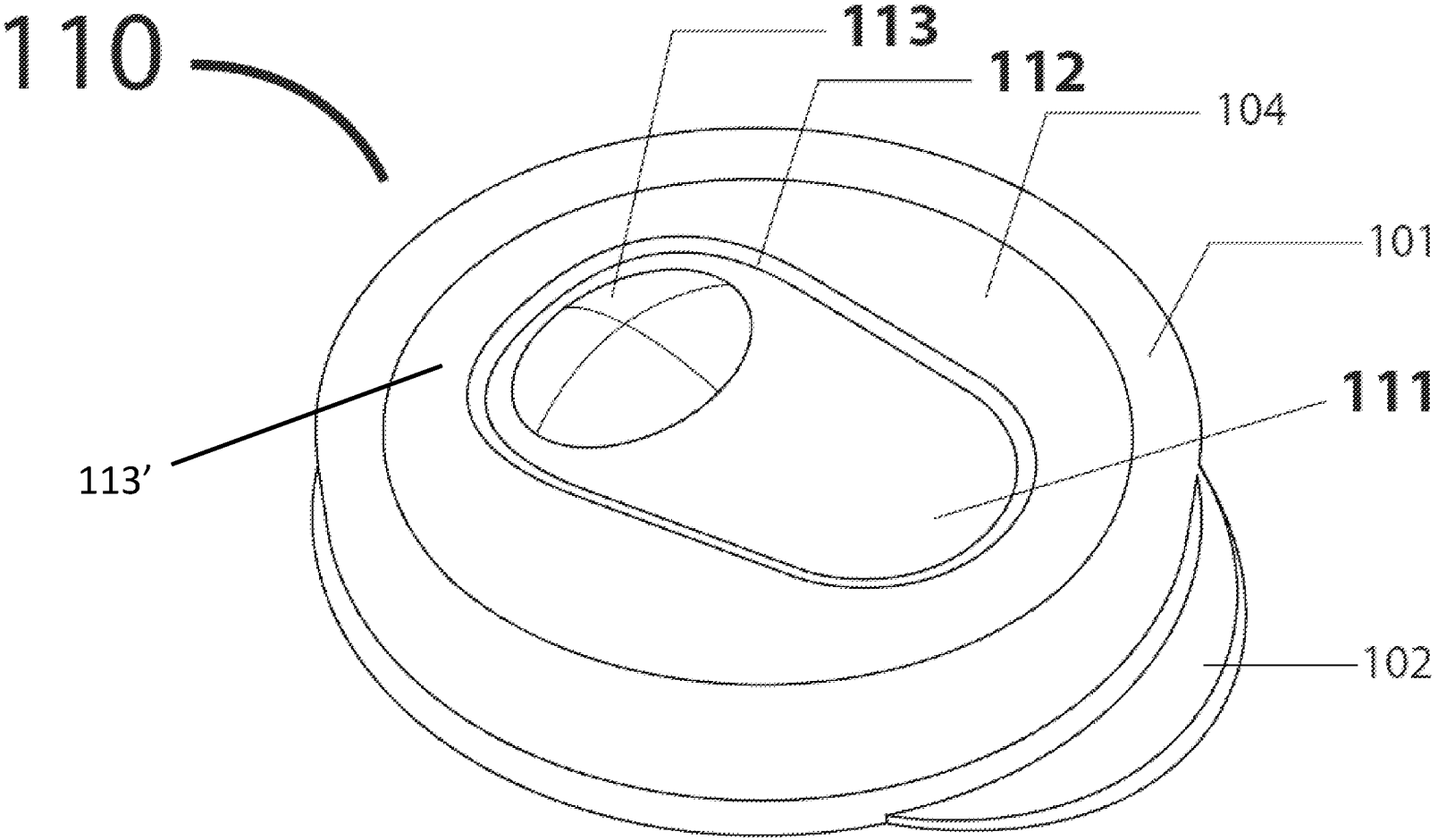
Figure 3F:
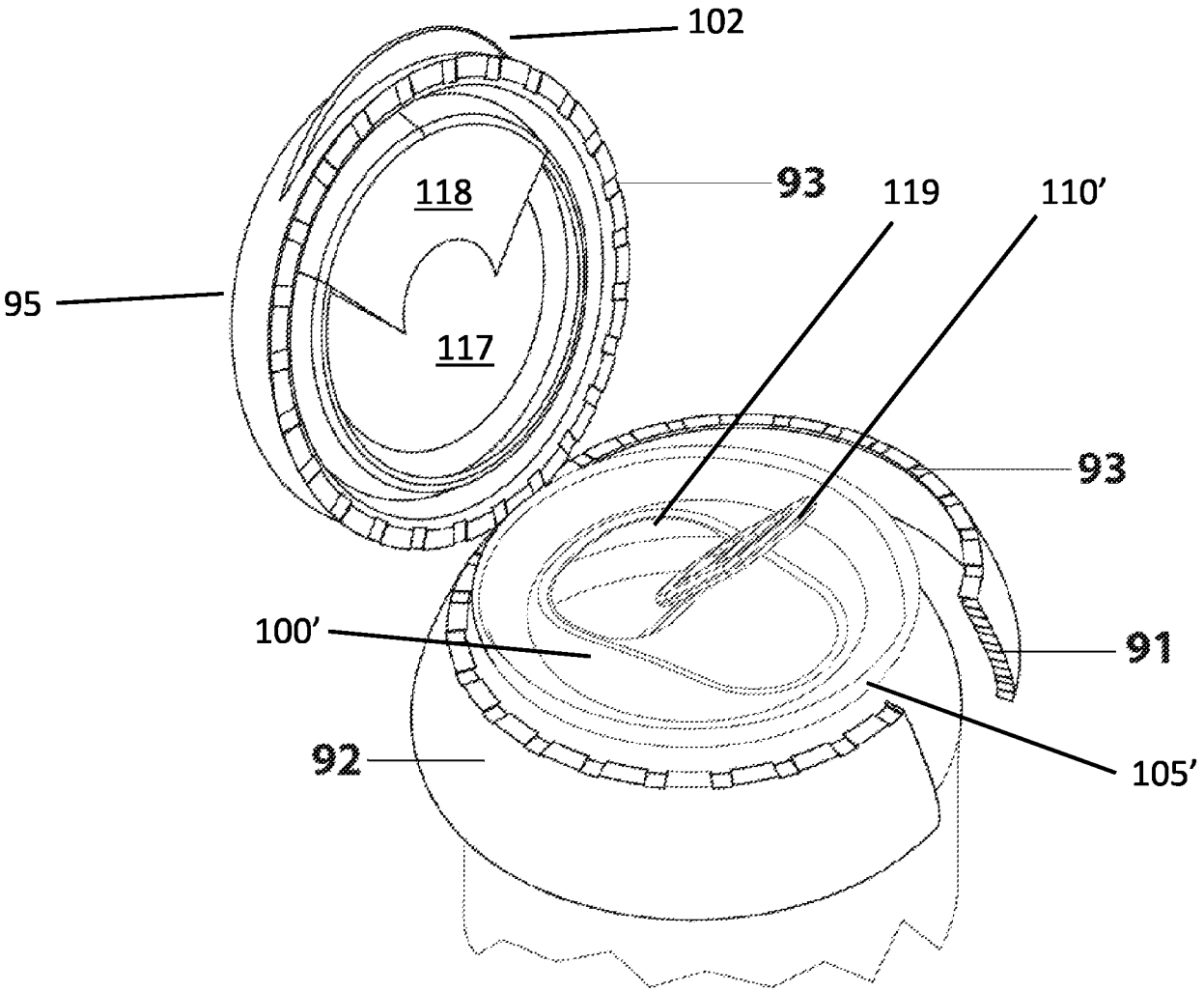

The best way of implementing the hygienic sealing and the lid for food and beverage containers is featured in terms of a preferred embodiment, as shown in FIGS. 3D and 3F. The cover is comprised of a body 101 of the cover 90 which has a lid 95 and an outer peripheral side wall 92 which extends downwards. The cover body 90 encloses the upper portion 100' of a beverage can 1 with a traction tab 110'. The body 101 of the cover 90 is preferably made of a thermoplastic material sufficiently flexible to articulate and hold the top portion 100' of the beverage can 1. It may be any type of material suitable for such application, such as polyethylene, polystyrene, polyvinyl chloride, polycarbonate polypropylene, polyester and the like. The properties allowing the cover to articulate and hold the can also are a formulation pre-requirement for each material.

The body 90 has a first perforated tearable line 93 around the complete outer peripheral side wall 92. This perforation allows the material to be torn away from the main structure of the cover 90, allowing a partial or complete detachment of the lid 95 from the exterior side wall 92. As such, the lid 22 can now be lifted allowing opening and access to the traction tab 110' and the content of the can 1. The outer side wall 92 may be partially or entirely removed from the cover 90 or the beverage can 1, as shown in FIG. 3F or it may be in an alternative embodiment, depicted in said FIG. 3F, where second tearable lines 91, 94 allow the outer side wall 92 to remain in place with the beverage can 1 or be completely removed from the same. The tearable lines 91, 93, 94 on the outer side wall 92 are preferably from ⅛ to ¼ the thickness of the body 90, thus allowing the lid 95 and the outer side wall to be easily removed by holding the same between the fingers and pulling in the opposite direction of the beverage can 1.

In another embodiment of the invention, referring to FIG.3E, the cover 110 has a section 111 in the shape of the traction tab 110' which is delineated 112 on the top surface 104 of the cover 110. Even though the partition or line 112 outlining the tab can have a variety of different shapes, it usually features a "loop" shape, which means no just a single curve but also a line comprised of a series of straight or curved line segments. Preferably, line 112 of the outline has a portion running relatively close to the edge 113' of the cover 110, where a raised and ovate protrusion 113 is located in the form of a push button, which is symmetrically disposed in the same position as the sealing element 101' and the perforated edge 102' of the tab 110' on the beverage can 1, so that when the protrusion 113 is pushed by a finger or thumb, the sealing element 101' of the can 1 is pushed inward, thus forming an opening (not shown) along the perforated edge 102' of the beverage can 1, which is relatively close to the thin edge 105' of the beverage can 1 so that the consumer can easily pour or drink the content of can 1 through such opening.

Figure 1:
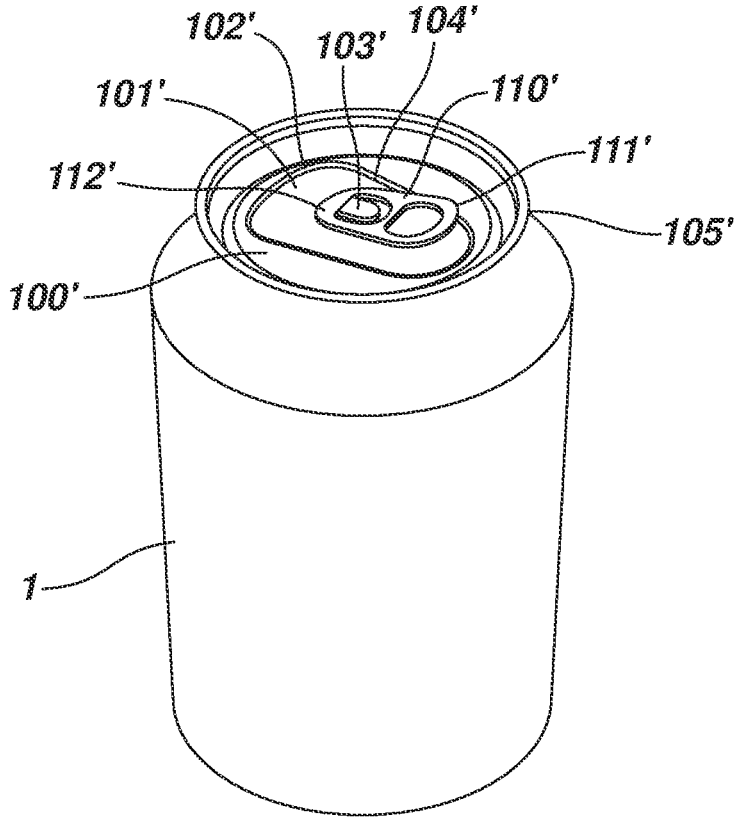
FIG. 1 shows a standard beverage can with a tab from the prior art.

FIGS. 4A-4E depicts a cross-sectional view of the combination of beverage can 1 opener and cover 100. As shown it features an internal cavity 115' between an outer peripheral wall 106 and an inner peripheral wall 108 of the cover, which is circumferential and forms a receiving area to intercept or adjust with the top surface 100' on a thin circular edge 105' of the beverage can 1. Additionally, as seen in the hollow interior 109 and the inner peripheral wall 108 of the cover 100 a can opener system 116 is formed adjacently. Consequently, the internal surface 117 of the cover 100 adjusts to the dome or top surface 100' of a standard beverage can 1 as the one shown in FIG. 1.

Figure 4A:
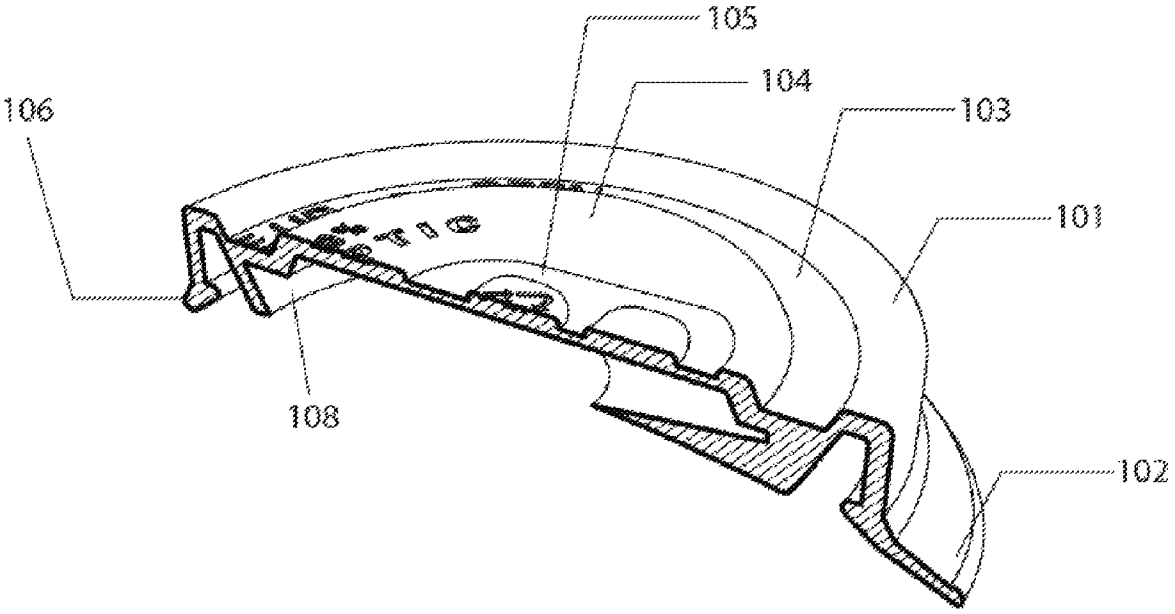
FIGS. 4A-4E are cross-sectional views of the cover in FIGS. 3A-3F.
Figure 5E:
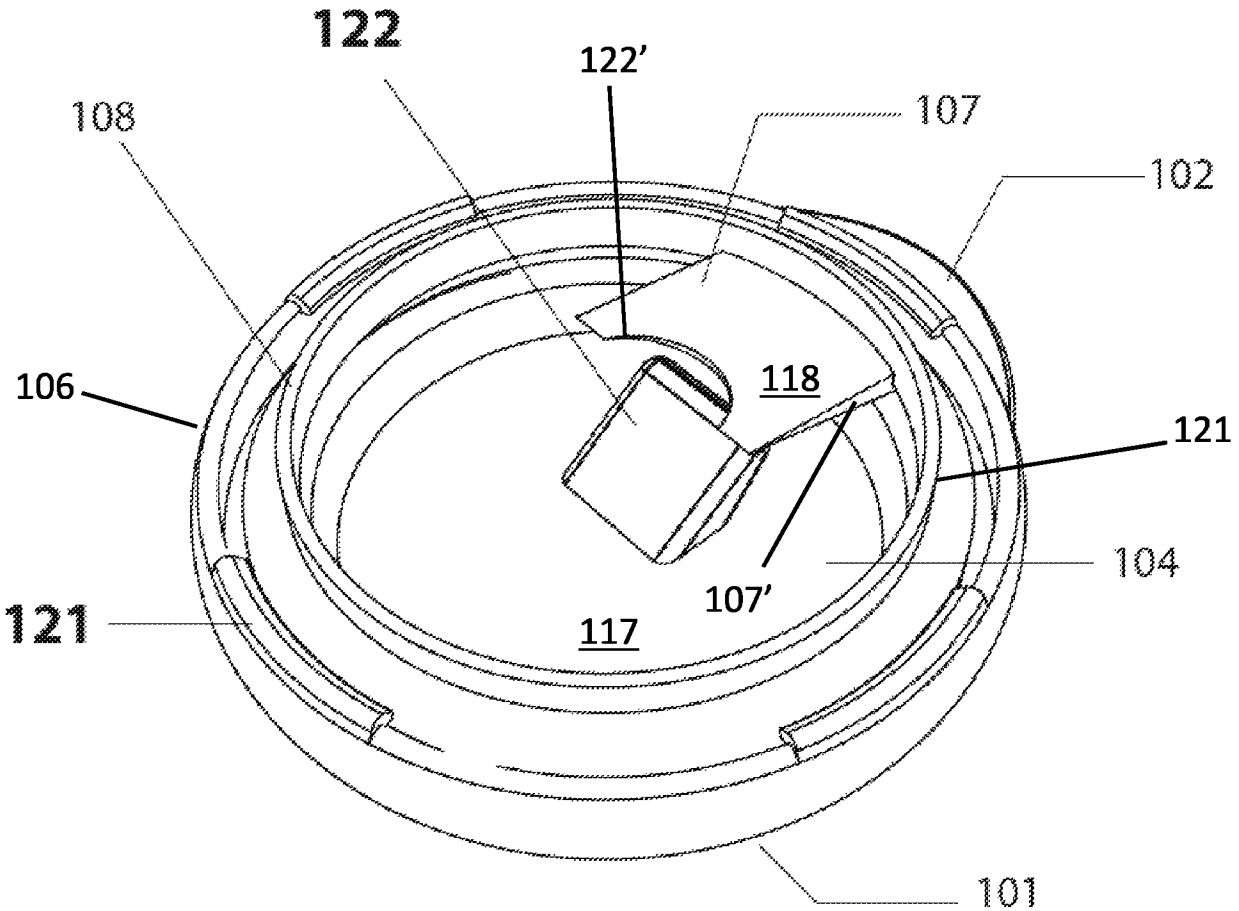
Figure 5F:
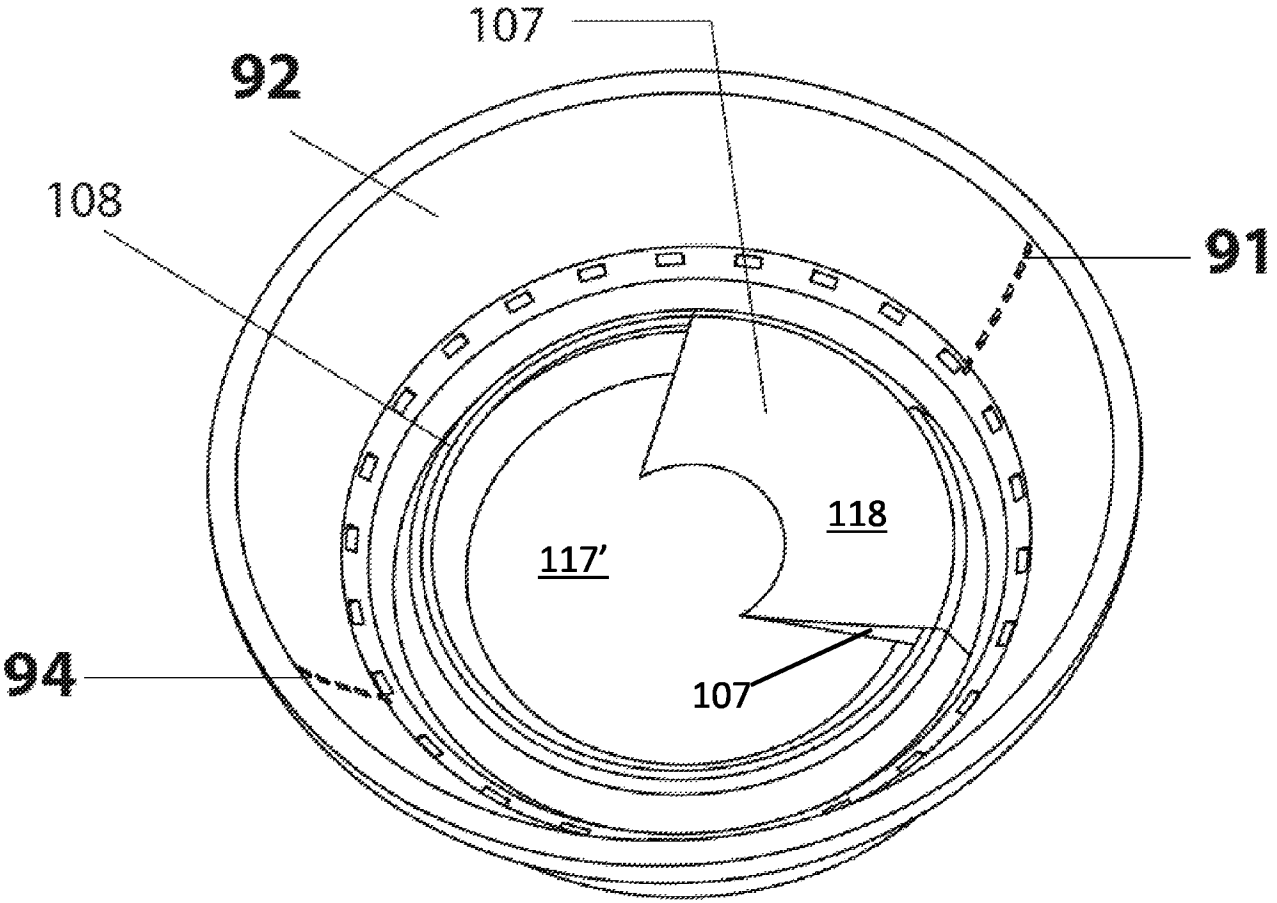

FIGS. 5A-5G depict a bottom view of cover 100 of this invention which features a can opener system 116, which comprises a molded notch 107 which is usually semicircular having a diameter of edge 107' whose length is dimensioned so that it generally matches the inside diameter of the inner wall 108 which extends circumferentially, being inclined downward and towards the center of the diameter of the circumference of the cover 100 featured in FIGS. 5A and 5F and may be even more in the cross-sectional view of FIGS. 4A and 4F, where the notch 107 has a conical area inclined downwards 118 leading to edge diameter 107' which is specifically configured to facilitate placement beneath the tab 110' of a beverage can 1. Thus, when the cover 100 is placed on the top surface of the beverage can 1, the same may be turned either clockwise or counterclockwise until the notch 107 forms something similar to a key which facilitates insertion of the cover 100 between the tab 110' of the can 1 and the top surface 100' of the beverage can 1 as shown in FIGS. 6A and 6F. Where the cover 100 is subsequently lifted by holding the grip 102 with the fingers of a user to open the beverage can 1.

Figure 4B:
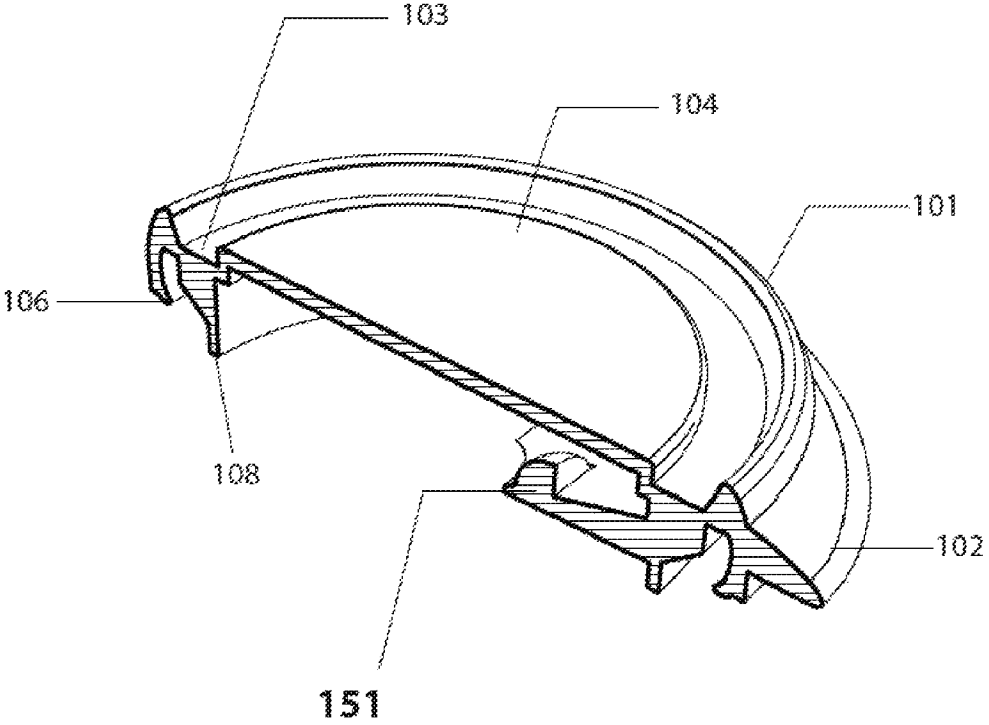
Figure 6A:
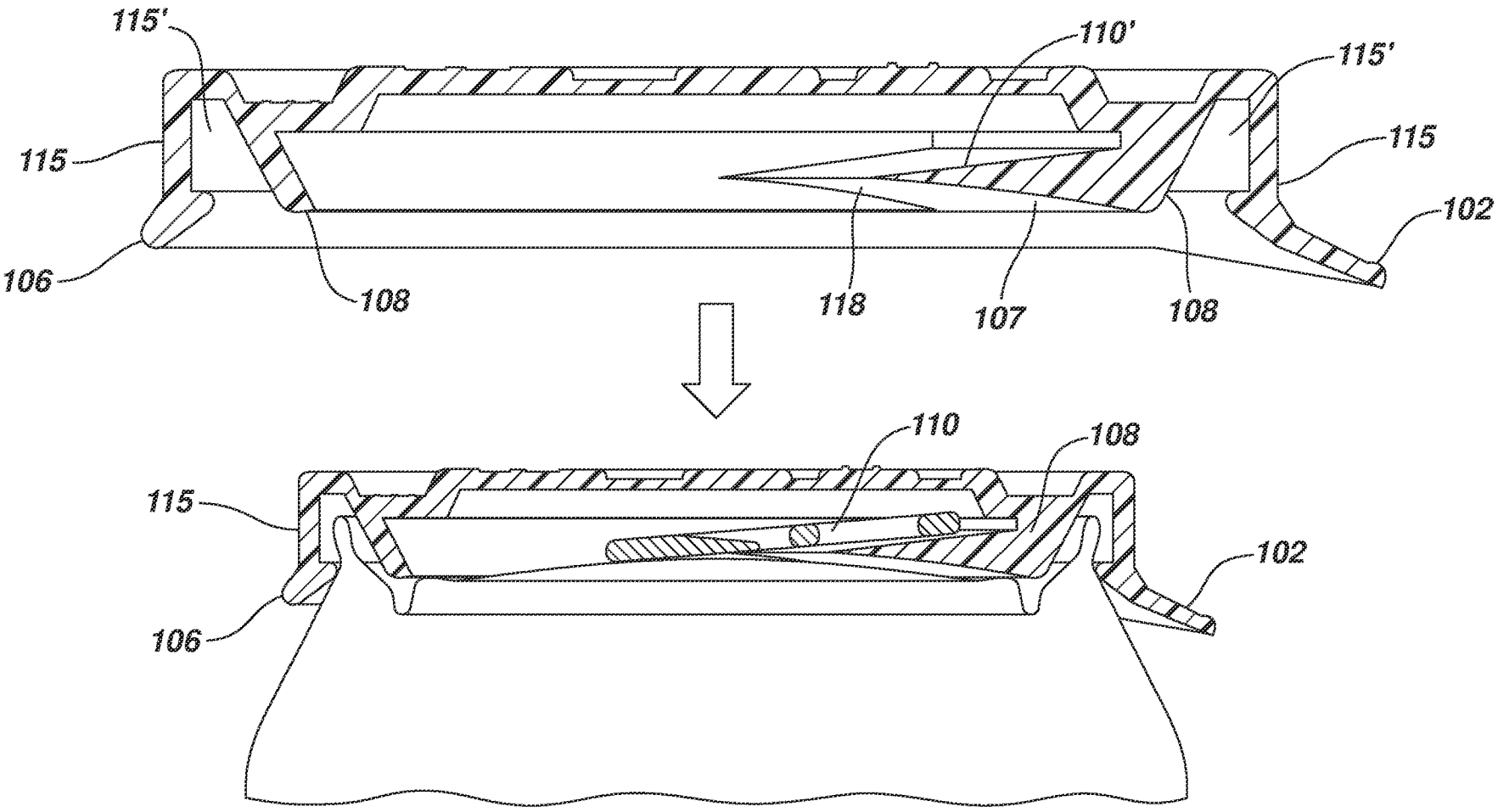
FIGS. 6A-6G are cross-sectional views of the beverage can with the cover in FIGS. 5A-5G.
Figure 6B:
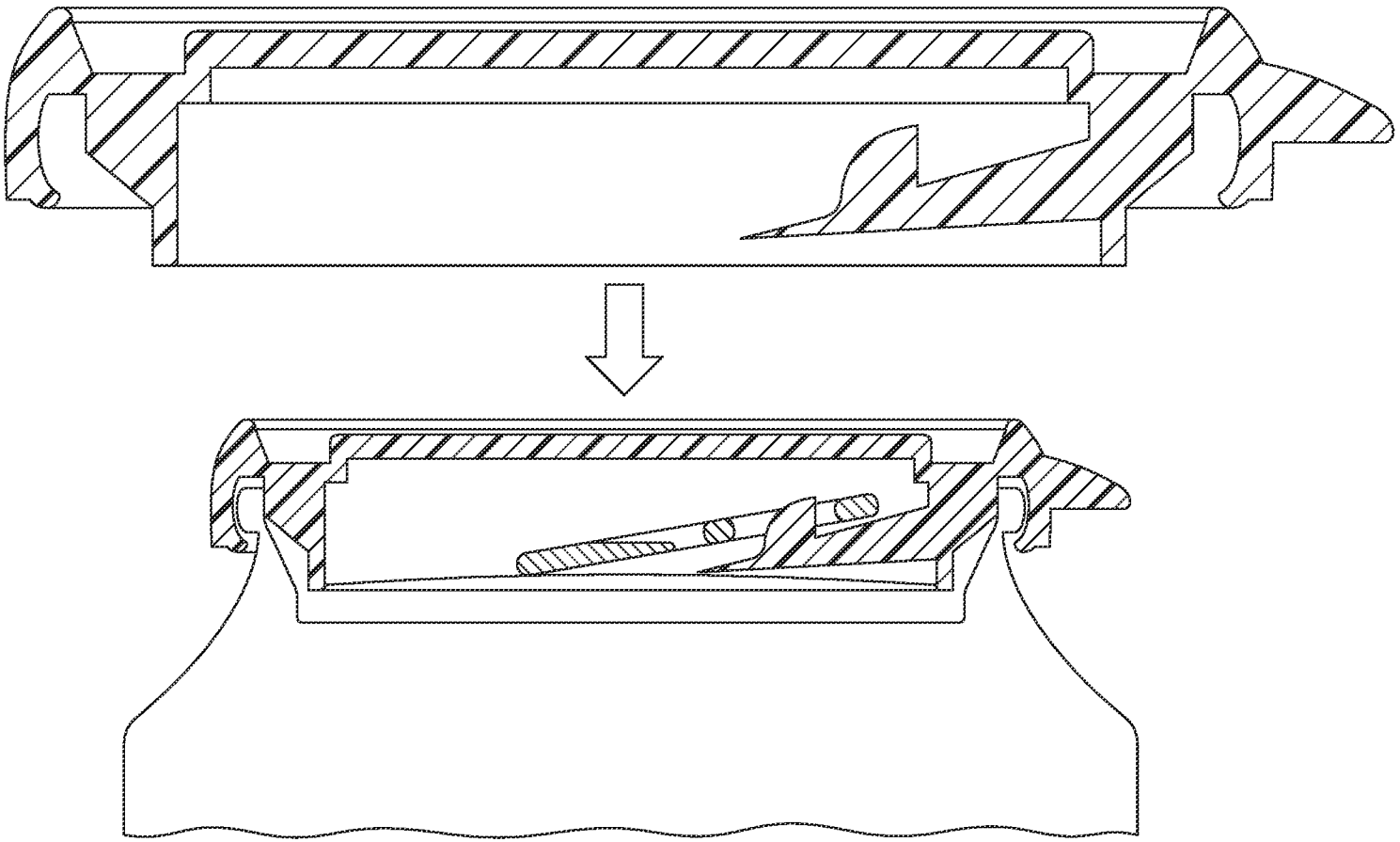

In another embodiment of the can opener system 116, which comprises a molded notch 151 which is generally semicircular having an edge diameter 107' the length of which is dimensioned to generally match the inside diameter of the inner wall 108 of the cover that extends circumferentially, inclined downward and towards the center of the circumference diameter of the cover 100 which is shown in FIG. 5B and may be even more in the cross-sectional view in FIG. 4B, wherein the notch 151 has a plurality of longitudinal inclined protrusions 152 which make contact with the traction tab 110' of the beverage can 1 and a conical area inclined downwards 118 which leads to the edge diameter 107' which is specifically configured to facilitate placement underneath the tab 110' of a beverage can 1. Thus, when the cover 100 is placed on the top surface 100' of the beverage can 1, the same may be turned either clockwise or counterclockwise until said notch 107 forms something similar to a key which facilitates insertion of the cover 100 between the tab 110' of the can 1 and the top surface 100' of the beverage can 1 as shown in FIG. 6B where the cover 100 is subsequently lifted by holding the grip 102 with the fingers of a user to open the beverage can 1.

Figure 4C:
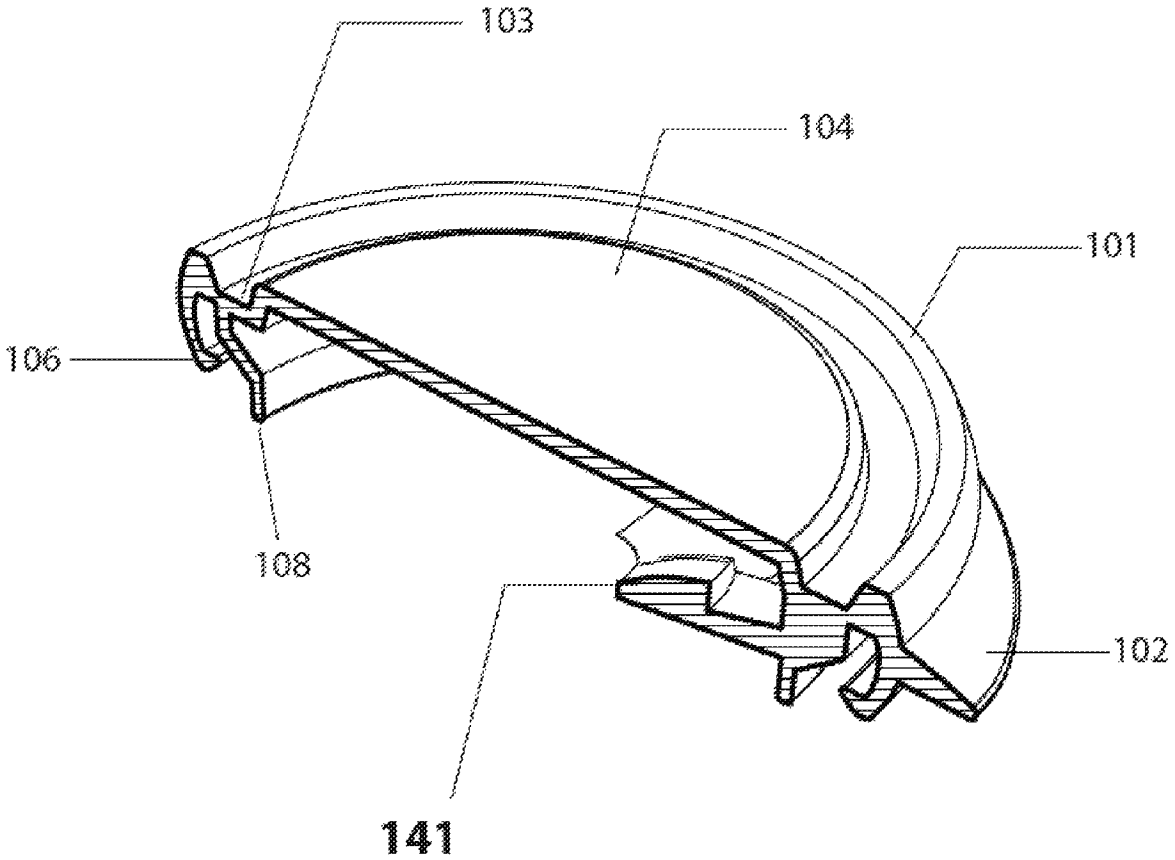
Figure 4D:
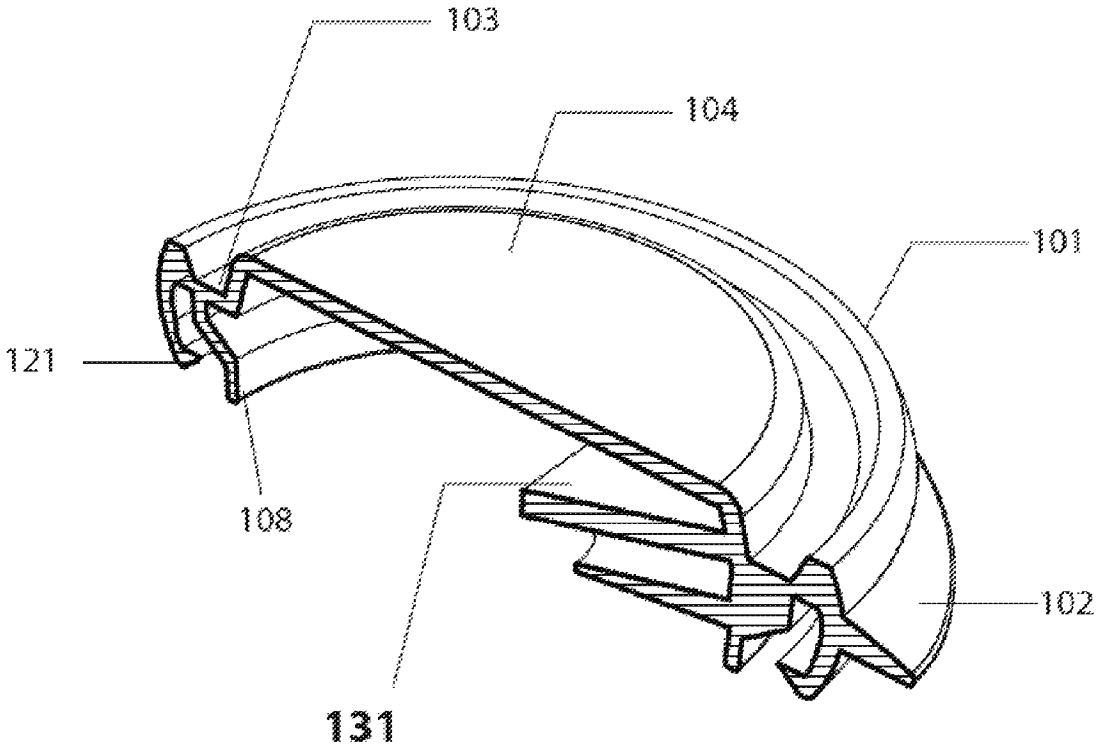
Figure 4E:
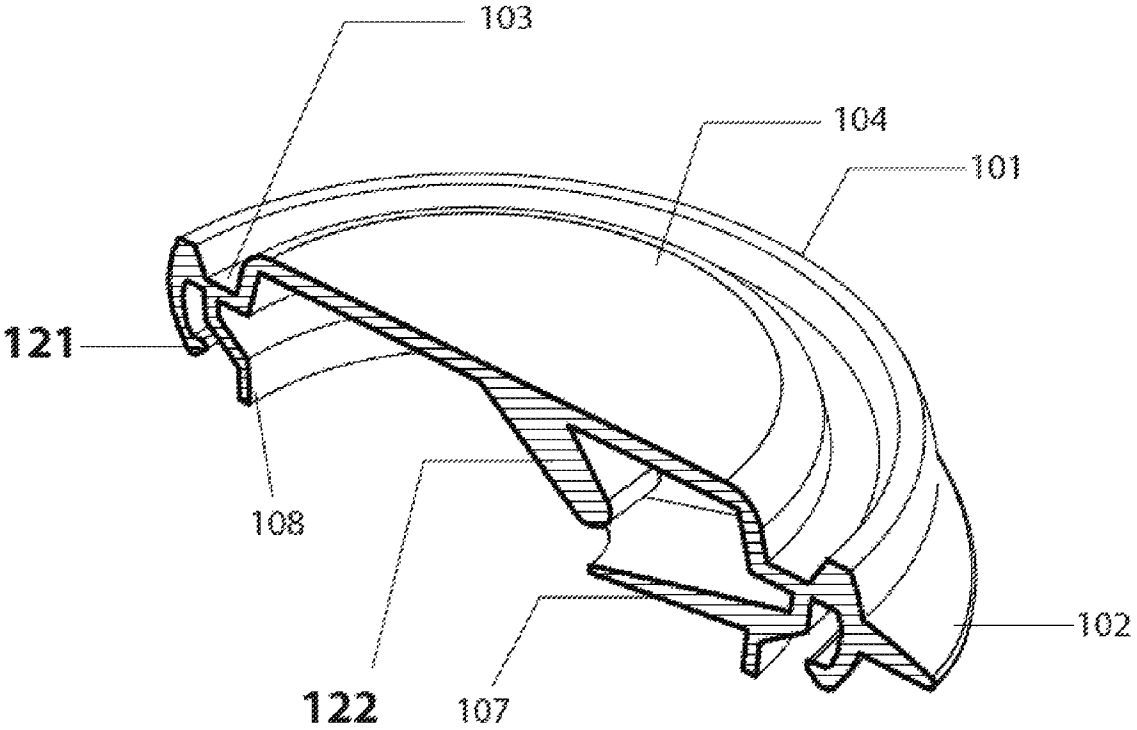
Figure 6C:
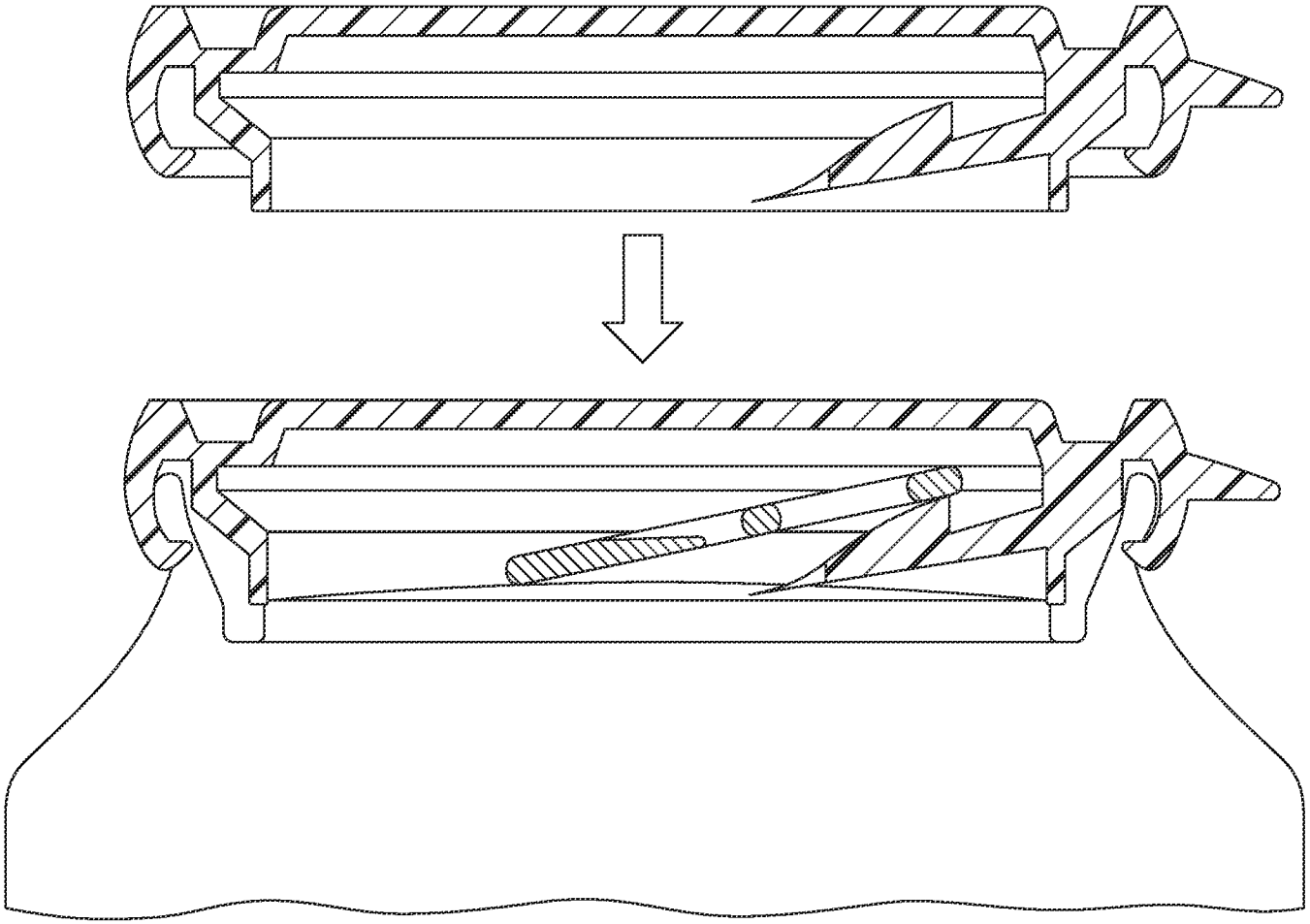

In another embodiment of the can opener system 116 which comprises a molded notch 141 which is substantially rectangular having an edge diameter 107' whose length is dimensioned so that it generally matches the inside diameter of the inner wall 108 of the cover which extends circumferentially, inclined downward and towards the center of the circumference diameter of the cover 100 shown in FIGS. 5C and may be even more in the cross-sectional view of FIG. 4C, wherein the notch 141 may optionally have a plurality of longitudinal inclined protrusions 152 which make contact with the traction tab 110' of the beverage can 1 and conical area inclined downwards 118 which leads to the diameter of the edge 107' which is specifically configured to facilitate placement underneath the tab 110' of a beverage can 1. Thus, when the cover 100 is placed on the top surface 100' of the beverage can 1, the same may be turned either clockwise or counterclockwise, until said notch 141 forms something similar to a key which facilitates insertion of the cover 100 between the tab 110' of the can 1 and the top surface 100' of the beverage can 1 as shown in FIG. 6C. Where the cover 100 is subsequently lifted by holding the grip 102 with the fingers of a user in order to open the beverage can 1.

Figure 6D:
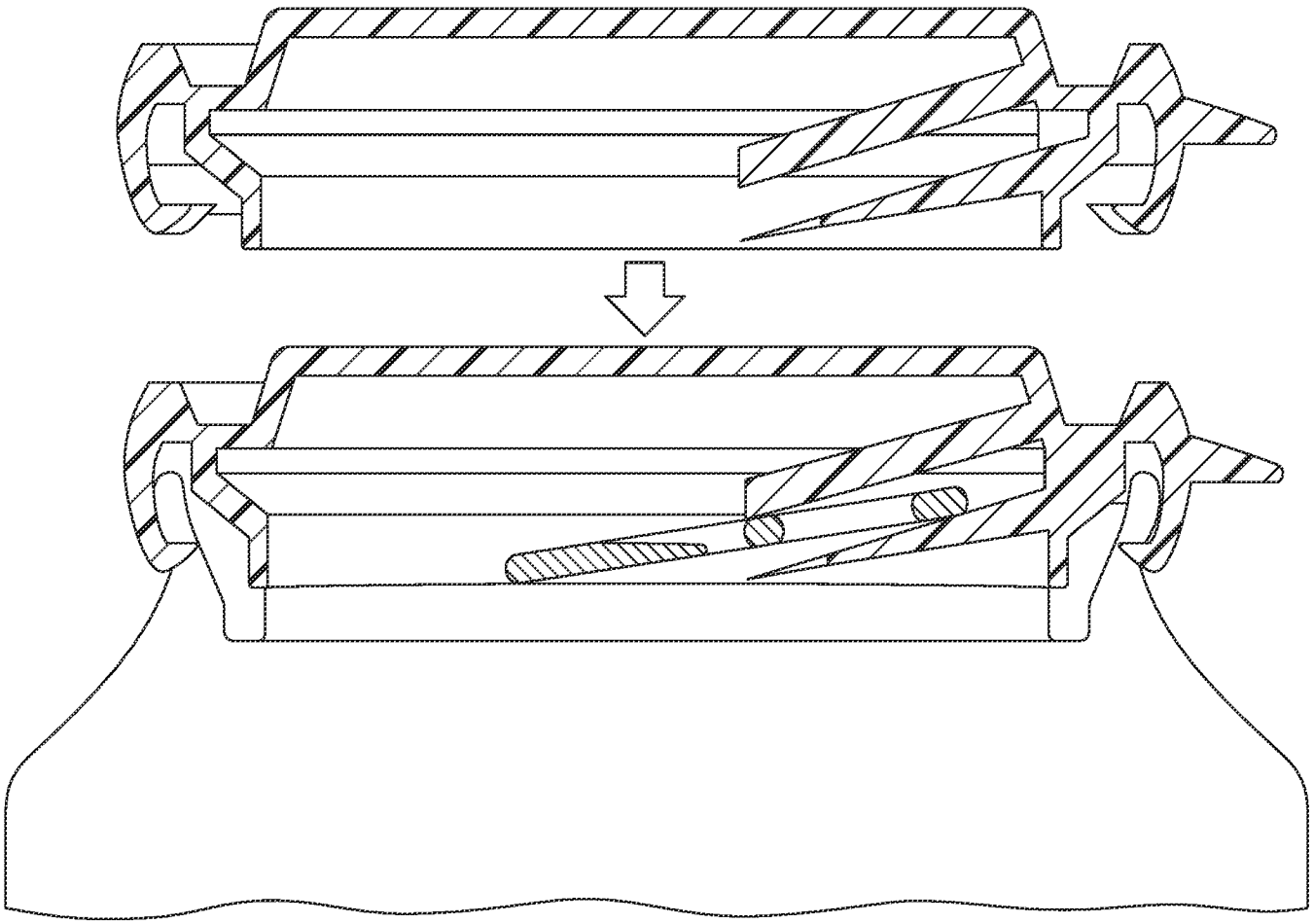

In another embodiment of the can opener system 116, which comprises a molded notch 131 which is substantially rectangular and the inside of which forms a hollow area 118' with a single opening 118', said notch 131 has an edge diameter 107' the length of which is dimensioned to generally match the inside diameter of the inner wall 108 of the cover that extends circumferentially inclined downwards and towards the center of the circumference diameter of the cover 100 shown in FIG. 5D, wherein the notch 131 has a conical area inclined downward 118 which leads to the edge diameter 107' which is specifically configured to facilitate placement underneath the tab 110' of a beverage can 1. Thus, when the cover 100 is placed on the top surface 100' of the beverage can 1, the same may be turned either clockwise or counterclockwise until such opening 118' of the notch 131 lodges inside thereof the tab 110' of the can 1 and forms something similar to a key which facilitates insertion of the cover 100 between the tab 110' of the can 1 and the top surface 100' of the beverage can 1 as shown in FIG. 6D. Where the cover 100 is subsequently lifted by holding the grip 102 with the fingers of a user to open the beverage can 1.

Figure 6E:
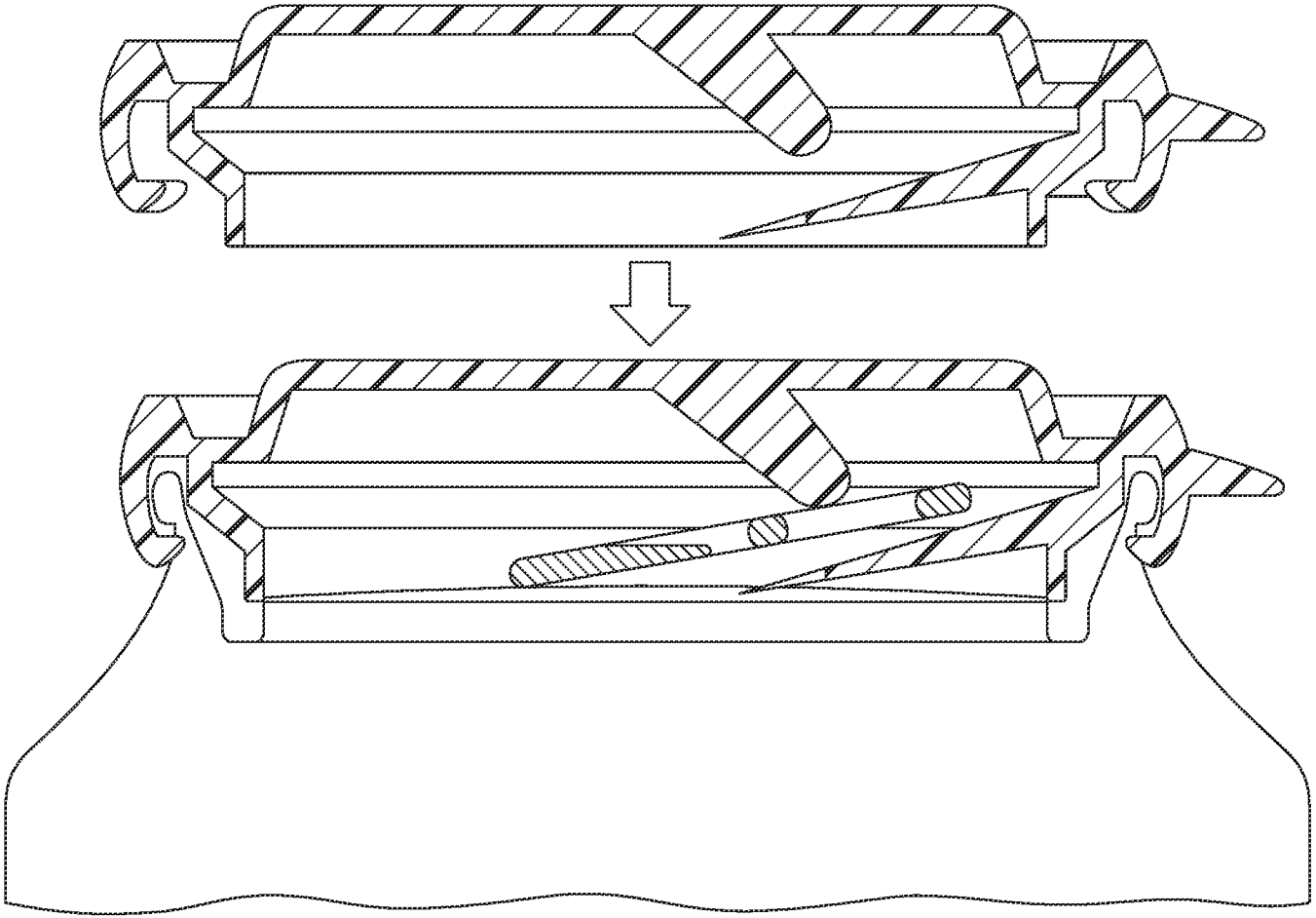

In another embodiment of the can opener system 116, which comprises a first molded notch 122 protruding from the center of the diameter of the interior surface 117 of the cover 100, wherein said notch 122 is inclined towards a second molded notch 107 without making contact with the same and leaving a gap 122' between the same. The second molded notch 107 is substantially rectangular having an edge diameter 107' whose length is dimensioned so that it generally matches the inside diameter of the inner wall 108 of the cover which extends circumferentially inclined downwards and towards the center of the diameter of the cover circumference 100 as shown in FIG. 5E and maybe even more in the cross-sectional view of FIG. 4E, wherein the notch 107 has a conical area inclined downwards 118 which leads to the edge diameter 107' which is specifically configured to facilitate placement beneath the tab 110' of the beverage can 1. Thus, when the cover 100 is placed on the top surface 100' of the beverage can 1, the same may be turned either clockwise or counterclockwise, until said gap 122' between the first notch 122 and the second notch 107 lodges inside thereof a traction tab 110' of the can 1 and form something similar to a key which facilitates insertion of the cover 100 between the tab 110' of the can 1 and the top surface 100' of the beverage can 1 as shown in FIG. 6E. Where the cover 100 is subsequently lifted by holding the grip 102 with the fingers of a user to open the beverage can 1.

Figure 5G:
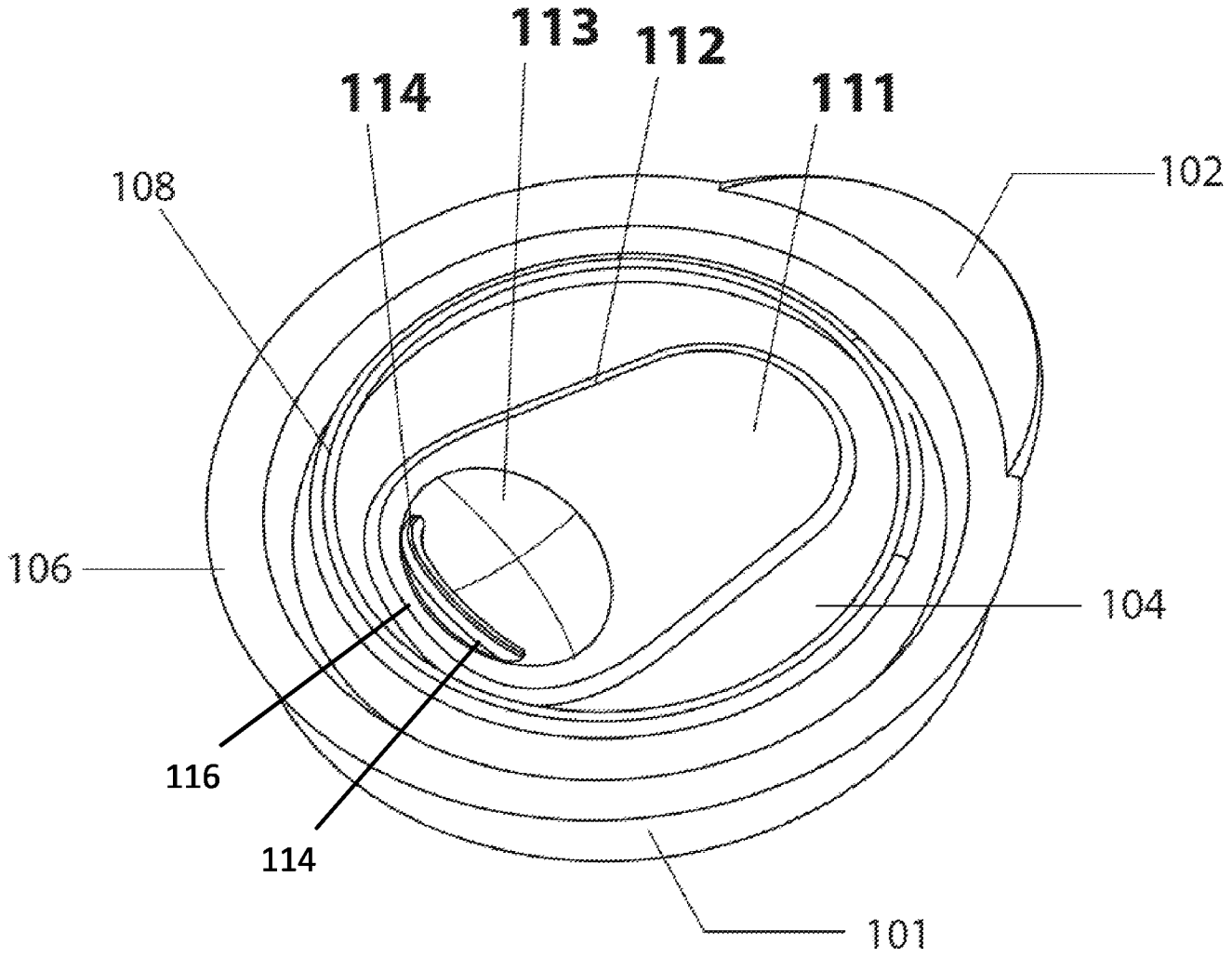
Figure 6F:
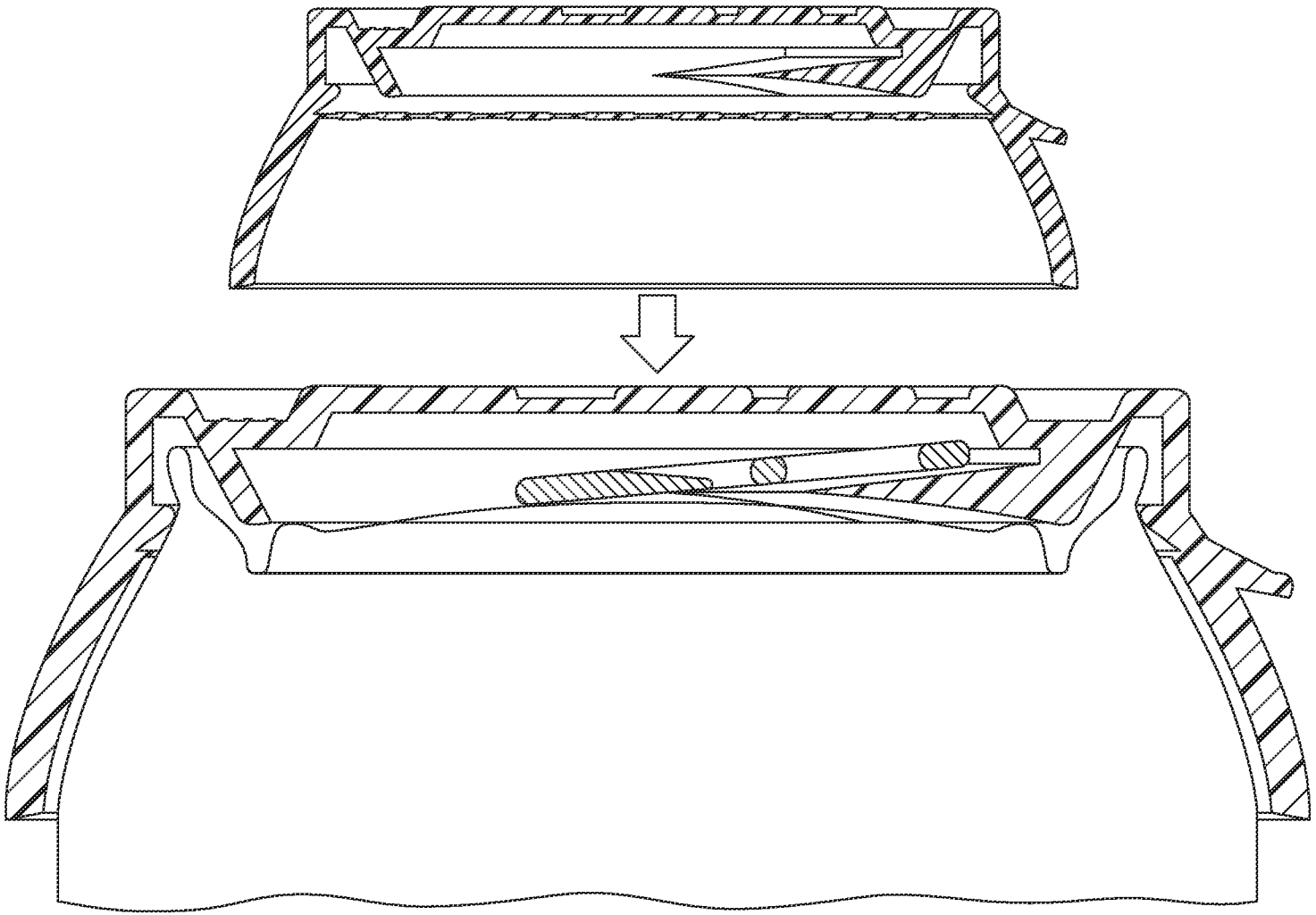
Figure 6G:
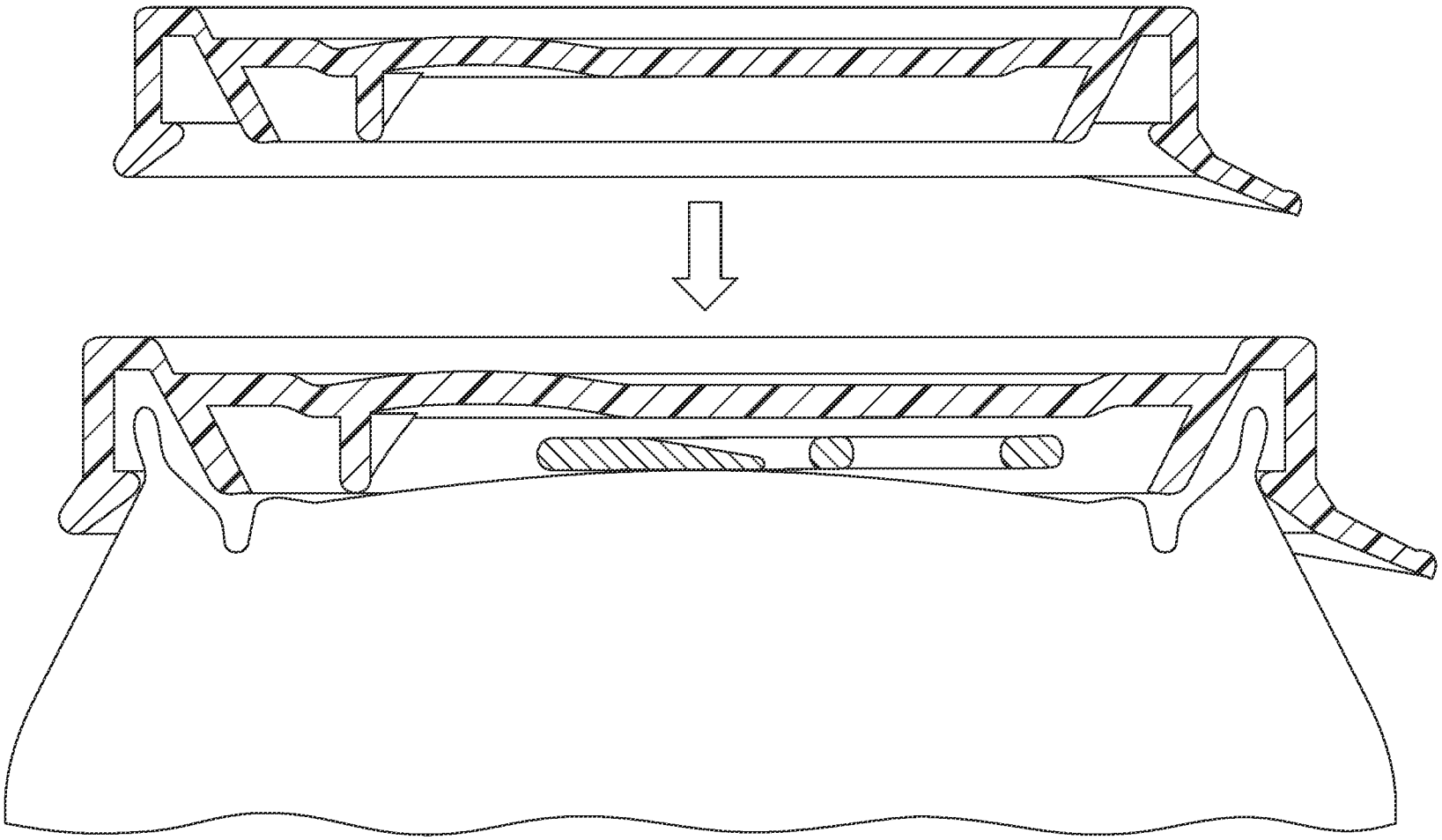

In another embodiment and in regard to FIG. 5G, the same depicts a bottom view of a cover 110 of this invention which shows a can opener system 116, which comprises a molded curved notch 114 which is generally semicircular and having an edge diameter 114' whose length is dimensioned so that it generally matches the outer perimeter of the ovate protrusion 113 which extends semi-circumferentially and vertically downwards as shown in FIG. 5G and maybe even more in the cross-sectional view of FIG. 4G, which shows the raised and ovate protrusion 113 over the exterior surface of the cover 110 and the molded curved notch 114 on the inner surface 117 of the cover 110, which extends downwards in the same length or depth of the inner wall 108 and outer wall 106 of the cover, being specifically configured to be placed symmetrically above in the same position as the sealing element 101' and the perforated edge 102' on the beverage can 1. Thus, when the cover 110 is placed on the top surface 100' of the beverage can 1, the same may be turned either clockwise or counterclockwise until said ovate protrusion 113 is symmetrically positioned over the sealing element 101' and the traction tab 110' on the beverage can 1, as shown in FIG. 6G. Wherein subsequently a consumer for opening the beverage can 1 employs a finger or thumb on the designated area of the ovate protrusion 113 of the cover 110 exerting pressure by pushing the same downwards until creating an opening 119 (FIG. 3F) along the scored edge 102' of the sealed element 101' in the beverage can 1.

Figure 7:
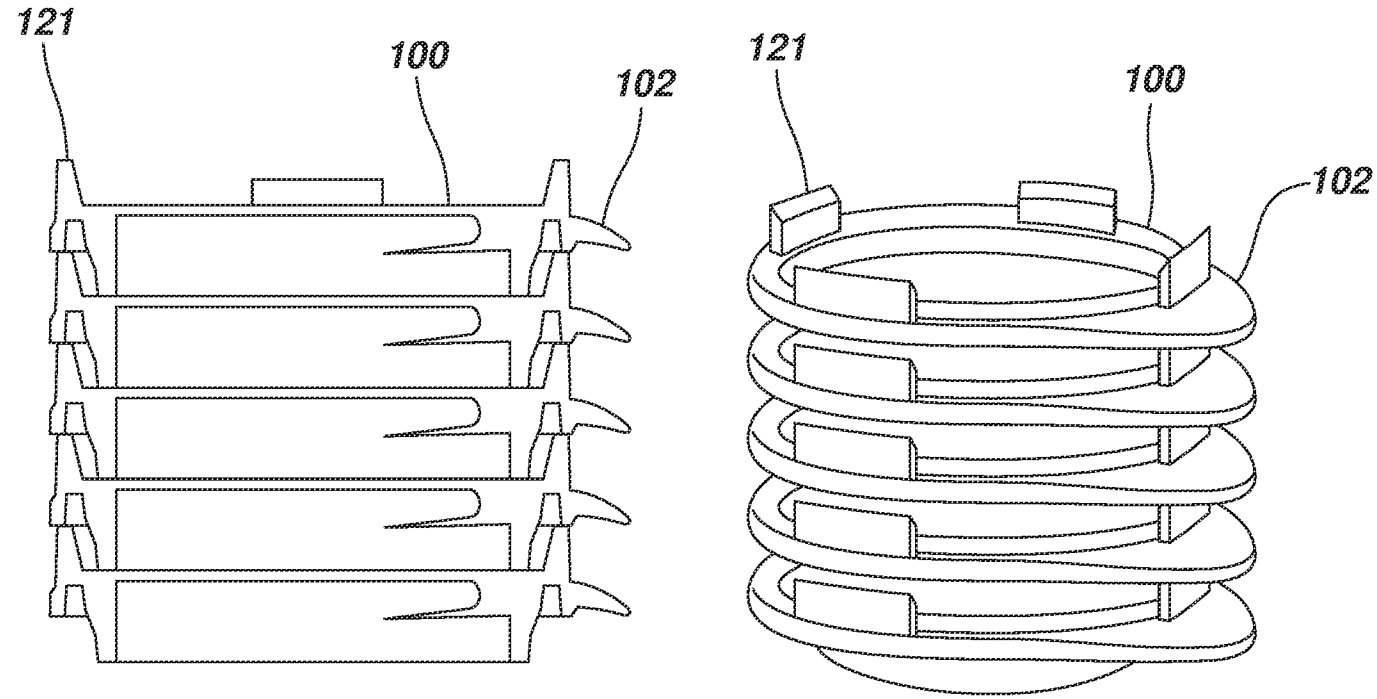
FIG. 7 is a lateral view depicting multiple stackable covers of FIGS. 3A-C stacked together.

FIG. 7 features the stacking of stackable covers 100 one on top of another, which is typically made when the stackable covers 100 are stored or transported by themselves. The bodies of covers 100 of the stackable covers may be aligned in such a manner that the attachment structures 121 of a first stackable cover superficially fit inside the circular cavity 103 of second stackable cover, while the attachment covers 121 of the second stackable cover fit inside the circular cavity of a third one and so forth. This arrangement reduces movement and provides a load structure to prevent deformation of the cover structures. It also reduces transport costs by allowing a high-density packaging of the covers.

Figure 8:
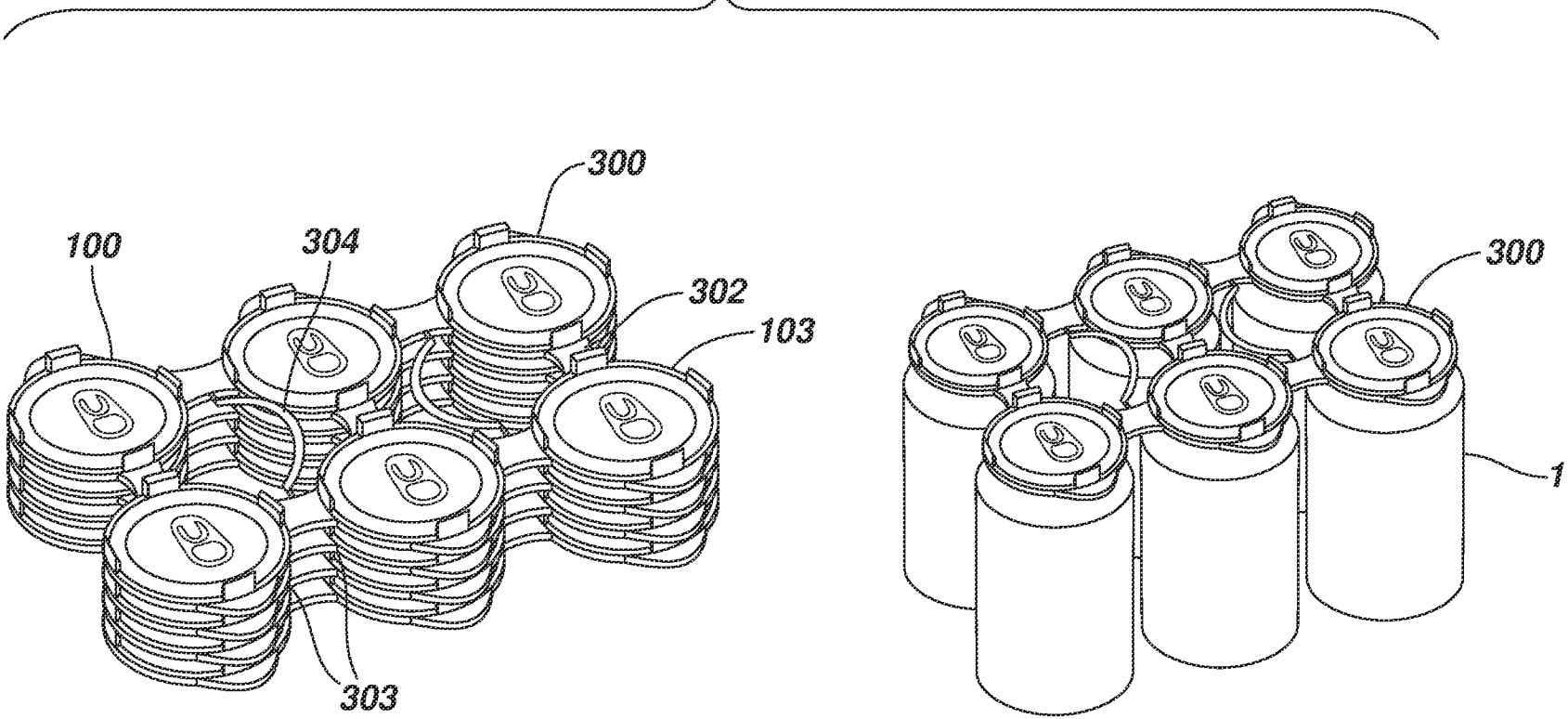
FIG. 8 depicts a perspective view from above of a novel stackable multiple can carrier constructed according to this invention and depicts the carrier to which a plurality of cans is interlockingly affixed.

FIG. 8 depicts a second embodiment in which multiple stackable covers 100 have been combined to form a multiple carrier 300 of beverage cans 1. The multiple carrier 300 of cans includes six stackable covers 100 in the depicted embodiment. However, it is noted that the multiple carrier of beverage cans may be alternatively provided with two, three, four, eight or any other number of multiple stackable covers 100. The stackable covers 100 are depicted to show that the movement is reduced and provides a load support to prevent deformation of the carrier structures. It also reduces transport costs by allowing a very dense multi-packaging of the carriers. The multiple carrier is preferably constructed as one element of a single piece by means of an adequate molding operation and is constructed of polymeric or copolymeric material.

The carrier 300 includes first bridge portions 301 which extend horizontally in FIG. 8 and second bridge portions 302 which run vertically in FIG. 8. These bridge portions 301, 302 are integrally made of the said stackable covers 100 and can also be integrated into a combined carrier. One or a pair of attachment loops 304 are also provided for a user to insert a finger and a thumb and carry the multiple package carrier and associated six beverage cans. The attachment loops 304 are depicted coupled with the respective first bridge portions 301 and formed inside a hole in a central region surrounded by four stackable covers 100, two first bridge portions 301 and two second bridge portions 302 of the multiple package carrier of beverage cans 1. It can be noted that the attachment loops 304 are typically configured to flex upwards under the weight of the beverage cans 1 when lifted.

Two opposing attachment loops 304 are typically provided in the embodiment of six cans depicted in FIGS. 2 and 8, and a single attachment loop 304 is typically provided in the embodiment of four cans (not shown). In addition, each attachment loop 304 is depicted being formed inside an internal hole in the multiple carrier 300 of beverage cans 1. However, in other embodiments pressure attachment loops may be formed which extend from a forward, back, right and/or left side of the multiple package container support (that is, the sides: upper, lower right or left of the multiple carrier of cans) (not shown). Finally, the bridge portions 301, 302 are preferably provided with a pair of weakened longitudinal lines 303. Due to the weakened lines 303, any or any selected number of cans 1 may be removed from the carrier 300 by simply pulling and obtaining the selective breakage of the flanges 303' along the weakened lines 303.

Figure 8A:
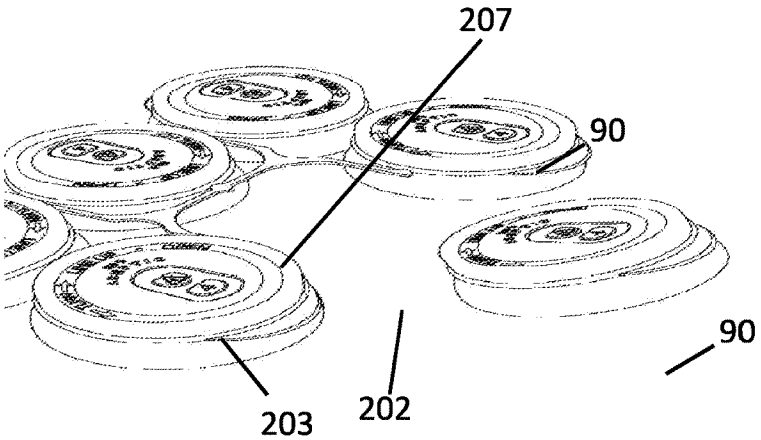
FIG. 8A is a preferred embodiment of a novel stackable multiple can carrier constructed according to this invention and depicts the carrier to which a plurality of covers in FIGS. 3A-3E is interlockingly affixed.
Figure 8A:
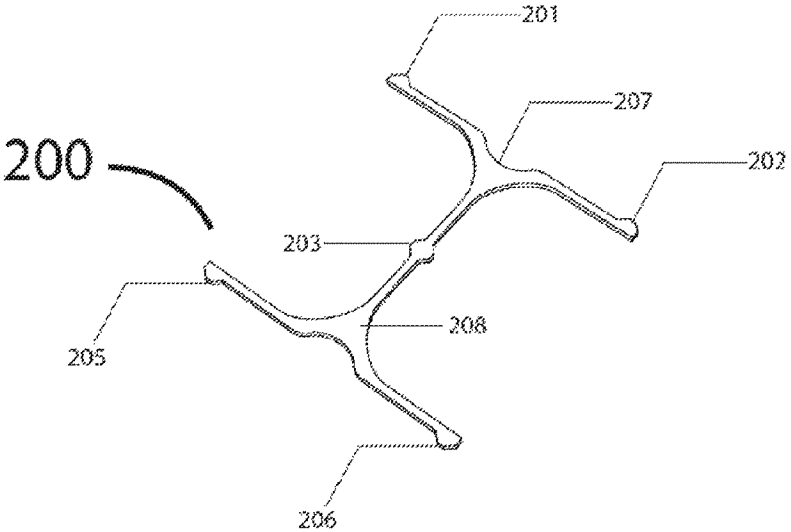
Figure 9:
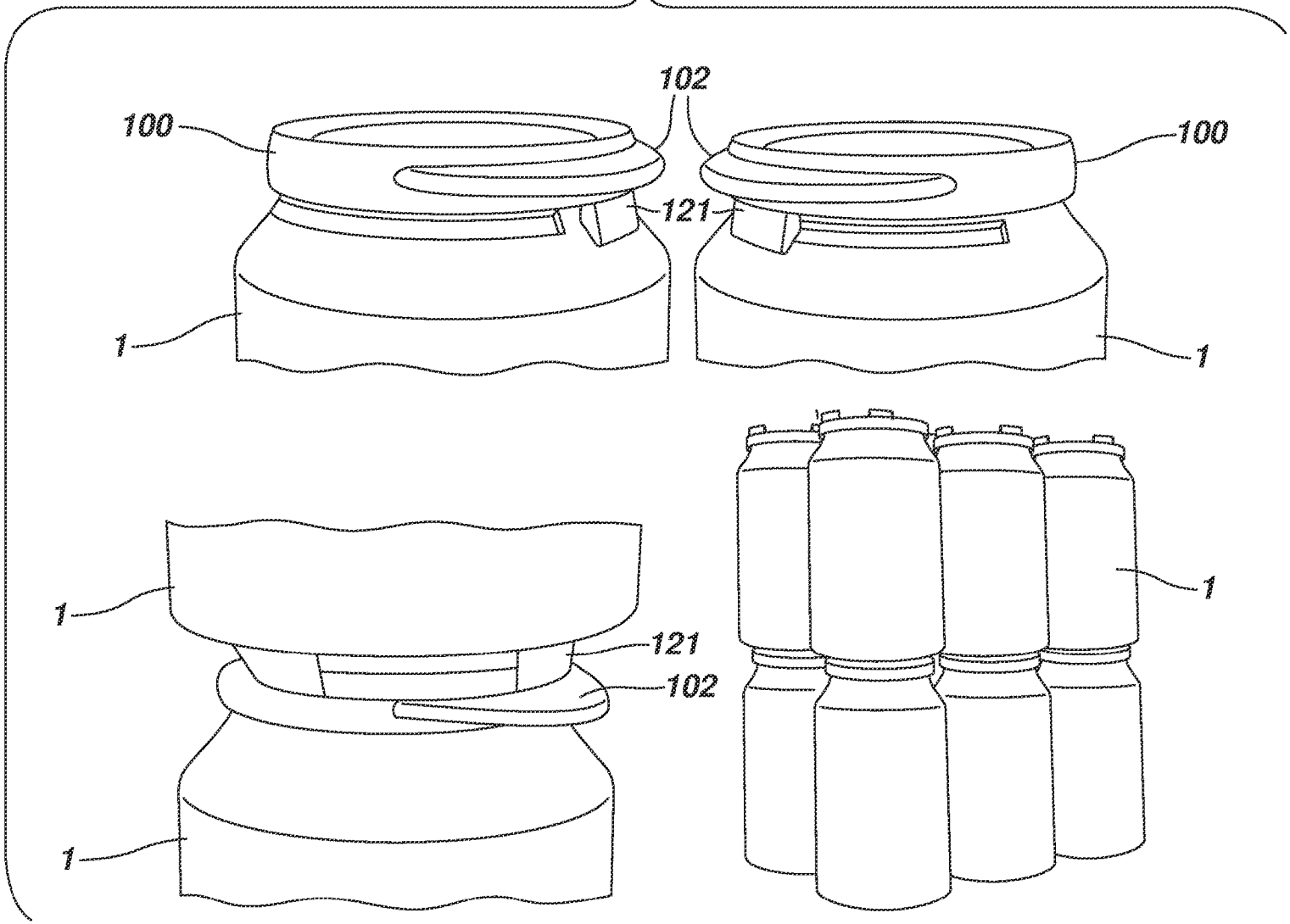
FIG. 9 is a top perspective view of the stacking system of interlocking cans with can carriers and in a stacked relation according to this invention.

In another embodiment referring to FIG. 8A, it depicts a multiple carrier 200 of beverage cans 1 having two weakened lines 207 on opposite sides and a central weakened line 208 joining said weakened lines 207, wherein said two weakened lines 207 comprise flanges 201, 202 and 205, 206 on the ending sides thereof, while the central weakened line 208 comprises a pair of flanges 203 at the center thereof. Due to the weakened lines 207 and 208 any or any selected number of cans 1 may be removed from the multiple carrier 200 as shown in FIG. 8A by simply pulling and obtaining the selective breakage of any of the flanges 201,202,205,206 along the weakened lines 207 and 208.

It should be understood that the embodiments of this invention are for illustrative not for limiting purposes, given that the scope of the invention is defined by the enclosed claims and not by the foregoing description and all changes falling within the limits of the claims or equivalency of, consequently, such purposes and limits of the same are destined to be covered by the claims. For example, even though the figures are drawn to scale, numerous variations can be made in the size and form of the depicted parts.

The invention claimed is:

1. A cover to shroud a beverage can, wherein the cover comprises:

a body, the body defining a hollow interior and a top surface covering the hollow interior of the body, the top surface comprising a protruding edge, the protruding edge configured to surround the periphery of the cover, the protruding edge comprising an inner wall adjacent to the cover and an outer wall disposed distal to the cover relative to the inner wall, the inner and outer walls being parallel to each other, so as to define a receiving area for an edge of a beverage can, configured to receive and surround a flange of the can, the receiving area being configured to be supported on the edge of the can, thus allowing the cover to shroud the top surface of the can;

a grip joined to the outer wall of the body and extending downwards, the grip being configured to be grabbed and lifted by a user, wherein the hollow interior comprises a can opener system which runs along the inner wall and forms a gap between said can opener system and an inner surface lodging a traction tab of the beverage can; and a plurality of attachment structures radially and equidistantly placed over the outer wall of the body.

2. A cover according to claim 1, wherein the body includes a lid and a peripheral outer side wall which extends downwards.

3. A cover according to claim 2, wherein the body has a first perforated tearable line extending around a peripheral outer side wall and a second perforated tearable line, wherein said first and second perforated tearable lines allow the lid and the peripheral outer side wall to be torn or removed partially or entirely from the cover.

4. A multiple carrier to protect the edges of beverage cans which comprises a plurality of the covers of claim 3, joined in the peripheries thereof on the same plane by two first weakened lines on opposite sides and a second central weakened line which joins said two first weakened lines, wherein the first two weakened lines comprise flanges on the ending sides thereof, Likewise, the second weakened line comprises a pair of flanges at the center thereof, wherein the first and second weakened lines are for pulling and removing any number of selected cans by means of the selective breakage of flanges along the first and second weakened lines.

5. A cover according to claim 1 wherein the top surface of the cover has a section in the shape of the beverage can traction tab, which is delineated over the top surface of the cover by a delineating line that runs relatively close to the protruding edge, wherein a raised ovate protrusion is located in the form of a push button, and such protrusion is symmetrically disposed in the same position as a sealing element of the can and a perforated edge of the beverage can traction tab.

6. A cover according to claim 5 wherein the can opener system comprises a molded curved notch having an edge diameter whose length is dimensioned so as to generally match the exterior perimeter of the ovate protrusion which extends semi-circumferentially and vertically downward running for the same length or depth of the inner and outer walls, being specifically configured to be placed symmetrically above in the same position as the sealing element and the perforated edge of the beverage can, so that, when the protrusion is pressed, the sealing element is pushed inwards, thus forming an opening along the perforated edge of the beverage can.

7. A cover according to claim 1 wherein the can opener system comprises a molded semi-circular notch having an edge diameter whose length is dimensioned so that it matches the interior diameter of the inner wall of the cover which runs circumferentially inclined downwards and towards the center of the circumference diameter of the cover, wherein the notch has a conical area inclined downwards leading to the edge diameter, which is configured to be lodged beneath the beverage can traction tab.

8. A cover according to claim 7 wherein the molded notch has a plurality of inclined longitudinal protrusions, which make contact with the traction tab of the beverage can.

9. A cover according to claim 7, wherein the molded notch is rectangular and there is a hollow area formed inside the molded notch with a single opening, which lodges inside the beverage can traction tab.

10. A cover according to claim 1, wherein the can opener system comprises a first molded notch which protrudes from the center of the lower surface diameter of the cover, wherein said notch is inclined towards a second molded notch without making contact with such second notch and leaving a gap between the same wherein the second molded notch is rectangular in shape having an edge diameter whose length is dimensioned so that it generally matches the interior diameter of the inner wall of the cover which runs circumferentially inclined downwards and towards the diameter center of the cover circumference, and wherein the notch has a conical area inclined downwards which leads to the edge diameter which is configured to facilitate placement underneath the tab of a beverage can.

11. A cover according to claim 1, wherein the cover body is made of a polymeric material sufficiently flexible to articulate and hold the top part of the beverage can.

12. A cover according to claim 11 wherein the polymeric material is selected from the group consisting of polyethylene, polystyrene, polyvinyl chloride, polycarbonate propylene, and polyester.

13. A cover according to claim 1 wherein the body of the cover is configured so that the attachment structures of a first stackable cover superficially fit inside a circular cavity of a second cover when the first cover is stacked on the second cover.

14. A multiple carrier to protect the edges of a plurality of beverage cans, the carrier comprising a plurality of covers of claim 1, joined at the peripheries thereof, on the same plane, by first bridge portions which run horizontally and second bridge portions running vertically, wherein said first and second bridge portions are integrally formed with the covers and integrate the same to the carrier.

15. The carrier of claim 14 wherein said plurality is four.

16. The carrier of claim 14 wherein said plurality is six.

17. The carrier of claim 14 further comprising a pair of attachment loops coupled to the respective first bridge portions and formed inside a hole in a central region surrounded by four covers, two first bridge portions and two second bridge portions of the multiple package carrier of beverage cans.

18. The carrier of claim 14, wherein the bridge portions comprise a pair of longitudinal weakened lines to pull and remove any selected number of cans by means of the selective breakage of flanges along the weakened lines.

19. The carrier of claim 14, wherein the carrier is made of a polymeric material sufficiently flexible to articulate and hold the top part of the beverage can.

20. A cover according to claim 1 wherein the top surface of the cover has a section in the shape of can traction tab, which is delineated over the top surface of the cover by a delineating line that runs relatively close to the protruding edge, wherein a raised and ovate protrusion is located in the form of a push button, and such protrusion is symmetrically disposed in the same position as a sealing element of the beverage can and a perforated edge of the beverage can traction tab.

21. A cover according to claim 1 wherein the can opener system comprises a molded semi-circular notch having an edge diameter whose length is dimensioned so that it matches the interior diameter of the inner wall of the cover which runs circumferentially inclined downwards and towards the center of the circumference diameter of the cover, wherein the notch has a conical area inclined downwards leading to the edge diameter, which is configured to be lodged beneath the beverage can traction tab.

22. A cover according to claim 21 wherein the molded notch has a plurality of inclined longitudinal protrusions, which make contact with the traction tab of the beverage can.

23. A cover according to claim 21, wherein the molded notch is rectangular and there is a hollow area formed inside the molded notch with a single opening, which lodges inside the beverage can traction tab.

24. A cover according to claim 1, wherein the cover body is made of a polymeric material sufficiently flexible to articulate and hold the top part of the beverage can.

25. A cover according to claim 24 wherein the polymeric material is selected from the group consisting of polyethylene, polystyrene, polyvinyl chloride, polycarbonate propylene, and polyester.

26. A cover to shroud a beverage can, wherein the cover comprises:

a body, having a lid and a peripheral outer side wall which extends downwards, the body defining a hollow interior and a top surface covering the hollow interior of the body, the top surface comprising a protruding edge, 22—the protruding edge configured to surround the periphery of the cover, the protruding edge comprising an inner wall adjacent to the cover and an outer wall disposed distal to the cover relative to the inner wall, the inner and outer walls being generally parallel to each other, so as to define a receiving area for an edge of the beverage can, configured to receive and surround a flange of the can, the receiving area being configured to be supported on the edge of the can, thus allowing the cover to shroud the top surface of the can; and a grip joined to the outer wall of the body and extending downwards, the grip being configured to be grabbed and lifted by a user, wherein the hollow interior comprises a can opener system which runs along the inner wall and forms a gap between said can opener system and an inner surface lodging a traction tab of the beverage can.

27. A cover according to claim 26, wherein a plurality of attachment structures are radially and equidistantly placed over the outer wall of the cover body.

28. A cover according to claim 27 wherein the body of the cover is configured so that the attachment structures of a first cover superficially fit inside a circular cavity of a second cover when the first cover is stacked on the second cover.

29. A cover according to claim 26, wherein the body has a first perforated tearable line extending around a peripheral outer side wall and a second perforated tearable line, wherein said first and second perforated tearable lines allow the lid and the peripheral outer side wall to be torn or removed partially or entirely from the cover.

30. A cover to shroud a beverage can, wherein the cover comprises:

a body, the body defining a hollow interior and a top surface covering the hollow interior of the body, the top surface comprising a protruding edge, the protruding edge configured to surround the periphery of the cover, the protruding edge comprising an inner wall adjacent to the cover and an outer wall disposed distal to the cover relative to the inner wall, the inner and outer walls being parallel to each other, so as to define a receiving area for an edge of a beverage can, configured to receive and surround a flange of the can, the receiving area being configured to be supported on the edge of the can, thus allowing the cover to shroud the top surface of the can; and a grip joined to the outer wall of the cover extending downwards, the grip being configured to be grabbed and lifted by a user, wherein the hollow interior comprises a can opener system which runs along the inner wall and forms a gap between said can opener system and an inner surface lodging a traction tab of the beverage can;

wherein a plurality of attachment structures are radially and equidistantly placed over the outer wall of the cover body, and the body of the cover is configured so that the attachment structures of a first cover superficially fit inside a circular cavity of a second cover when the first cover is stacked on the second cover.

31. A multiple carrier to protect the edges of a plurality of beverage cans, the carrier comprising: a plurality of covers, each cover comprising (a) a body, the body defining a hollow interior and a top surface covering the hollow interior of the body, the top surface comprising a protruding edge, the protruding edge configured to surround the periphery of the cover, the protruding edge comprising an inner wall adjacent to the cover and an outer wall disposed distal to the cover relative to the inner wall, the inner and outer walls being parallel to each other, so as to define a receiving area for an edge of a beverage can, configured to receive and surround a flange of the can, the receiving area being configured to be supported on the edge of the can, thus allowing the cover to shroud the top surface of the can; and (b) a grip joined to the outer wall of the body extending downwards, the grip being configured to be grabbed and lifted by a user, wherein the hollow interior comprises a can opener system which runs along the inner wall and forms a gap between said can opener system and an inner surface lodging a traction tab of the beverage can;

wherein the covers are joined at the peripheries thereof, on the same plane, by first bridge portions which run horizontally and second bridge portions running vertically, and said first and second bridge portions are integrally formed with the covers and integrate the same to the carrier.

* * * * *